US008147043B2

(12) United States Patent
Kojima et al.

(10) Patent No.: US 8,147,043 B2
(45) Date of Patent: Apr. 3, 2012

(54) BACK PRESSURE ADJUSTMENT APPARATUS FOR LIQUID EJECTION HEAD

(75) Inventors: Toshiya Kojima, Kanagawa-ken (JP); Yasuhiko Kachi, Kanagawa-ken (JP); Masahito Katada, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 1040 days.

(21) Appl. No.: 12/045,975

(22) Filed: Mar. 11, 2008

(65) Prior Publication Data

US 2008/0231650 A1 Sep. 25, 2008

(30) Foreign Application Priority Data

Mar. 22, 2007 (JP) ..... 2007-075251

(51) Int. Cl.
*B41J 2/175* (2006.01)

(52) U.S. Cl. ..... 347/85; 347/17; 347/6

(58) Field of Classification Search ..... 347/17, 347/84–87, 92
See application file for complete search history.

(56) References Cited

U.S. PATENT DOCUMENTS

| | | | | |
|---|---|---|---|---|
| 4,595,183 | A * | 6/1986 | Dan et al. | 267/140.13 |
| 5,975,330 | A * | 11/1999 | Sasaki et al. | 220/495.01 |
| 6,213,598 | B1 * | 4/2001 | Hou et al. | 347/86 |
| 6,334,670 | B1 * | 1/2002 | Yoshihira et al. | 347/65 |
| 6,773,099 | B2 * | 8/2004 | Inoue et al. | 347/86 |
| 7,360,882 | B2 | 4/2008 | Ikeda et al. | |
| 7,452,065 | B2 * | 11/2008 | Ogawa | 347/92 |
| 8,042,902 | B2 * | 10/2011 | Katada | 347/17 |
| 8,047,644 | B2 | 11/2011 | Ikeda et al. | |
| 2003/0067520 | A1 | 4/2003 | Inoue et al. | |
| 2003/0069466 | A1 * | 4/2003 | Tsukahara et al. | 600/16 |
| 2004/0223036 | A1 | 11/2004 | Inoue et al. | |
| 2007/0046747 | A1 * | 3/2007 | Takemoto | 347/92 |

FOREIGN PATENT DOCUMENTS

| | | | |
|---|---|---|---|
| JP | 2003-251826 | A | 9/2003 |
| JP | 2005-41048 | A | 2/2005 |
| JP | 2006-95876 | A | 4/2006 |
| JP | 2006-95878 | A | 4/2006 |
| JP | 2006-192785 | A | 7/2006 |
| JP | 2006-297902 | A | 11/2006 |

OTHER PUBLICATIONS

JP Office Action issued in application No. 2007-075251 on Nov. 11, 2011.

* cited by examiner

*Primary Examiner* — Ellen Kim
(74) *Attorney, Agent, or Firm* — Birch, Stewart, Kolasch & Birch, LLP

(57) ABSTRACT

The back pressure adjustment apparatus for a liquid ejection head has: a container having a liquid accommodating chamber which is connected to the liquid ejection head and accommodates liquid to be supplied to the liquid ejection head, and a gas accommodating chamber which accommodates gas; a movable film which separates the liquid accommodating chamber and the gas accommodating chamber, and forms a portion of whole walls of the liquid accommodating chamber; and a pressure adjustment device which causes all or a portion of the movable film to deform so as to adjust pressure of the liquid accommodated in the liquid accommodating chamber.

14 Claims, 21 Drawing Sheets

BACK PRESSURE ADJUSTMENT APPARATUS FOR LIQUID EJECTION HEAD

BACKGROUND OF THE INVENTION

1. Field of the Invention

The present invention relates to a back pressure adjustment apparatus for a liquid ejection head which is capable of stabilizing variations in the back pressure in a liquid ejection head.

2. Description of the Related Art

A liquid ejection head has been proposed, which comprises nozzles which eject ink and pressure chambers connected to the nozzles, liquid being ejected from a nozzle by changing the pressure of the liquid inside the corresponding pressure chamber. A liquid ejection head of this kind comprises a sub tank which is connected to the liquid ejection head, and the pressure of liquid inside the sub tank is adjusted and treated as the back pressure of the liquid ejection head.

Furthermore, Japanese Patent Application Publication No. 2005-41048 and Japanese Patent Application Publication No. 2006-192785 teach the technology in which a flexible bag is provided inside a rigid container (sub tank), and by changing the volume of this flexible bag, the back pressure of a liquid ejection head connected to the bag is adjusted.

However, if the back pressure in a liquid head is adjusted by altering the volume of the flexible bag, then since the shape of the bag does not generally change in a stable fashion, sudden pressure changes may occur when the volume of the bag changes, and it is difficult to achieve fine adjustment of the back pressure.

FIG. 21A shows a state where ink has been filled into a bag 91 inside a sub tank 90 and the volume of the bag 91 is a maximum (a state where there are no creases in the bag 91), and FIG. 21B shows a state where ink has been supplied from the bag 91 in the sub tank 90 to the liquid ejection head 50 and the volume of the bag 91 has become smaller (in other words, a state where creases have occurred in the bag 91). The moment that a crease occurs, the pressure inside the bag 91 changes suddenly. Furthermore, if the volume of the bag 91 which contains creases becomes larger due to replenishment of ink into the bag 91, then the creases disappear. The moment that such a crease disappears, the pressure inside the bag 91 changes suddenly. Since sudden pressure changes occur in this way when the volume of the bag 91 varies, in general, it is difficult to achieve fine pressure adjustment at a resolution below 10 mm $H_2O$.

Furthermore, it is known that since a bag structure is generally formed by creating joins using a thermal pressurization method, then in a state such as that shown in FIG. 21B, virtually no ink flows in the vicinity of the join regions, and aggregation of pigment or resin components (latex) arises, giving rise to ink blockages in the liquid ejection head.

Moreover, if it sought to eject ink at a resolution of 1000 dpi or above and a speed exceeding 300 mm/s, using a long head exceeding 8 inches in length, then the ink consumption per color exceeds around 20 cc/min. If ink ejection involving high duty of this kind is required, then a high-capacity bag having a volume greater than 1000 cc is required. However, since the creases described above are particularly liable to occur in the case of a large bag shape, it is generally difficult to use a bag of large capacity exceeding 500 cc.

SUMMARY OF THE INVENTION

The present invention has been contrived in view of these circumstances, an object thereof being to provide a back pressure adjustment apparatus for a liquid ejection head which is suited to the supply of large volume of liquid and which is able to stabilize variation in the back pressure of the liquid ejection head.

In order to attain an object described above, an aspect of the present invention relates to a back pressure adjustment apparatus for a liquid ejection head, the back pressure adjustment apparatus comprising: a container having a liquid accommodating chamber which is connected to the liquid ejection head and accommodates liquid to be supplied to the liquid ejection head, and a gas accommodating chamber which accommodates gas; a movable film which separates the liquid accommodating chamber and the gas accommodating chamber, and forms a portion of whole walls of the liquid accommodating chamber; and a pressure adjustment device which causes all or a portion of the movable film to deform so as to adjust pressure of the liquid accommodated in the liquid accommodating chamber.

If a liquid accommodating chamber of large capacity is required for a liquid ejection head having a large number of nozzles, then if a bag is used as the liquid accommodating chamber, as in the related art, the surface of the boundary between the bag and the gas accommodating chamber forming the space outside same is composed entirely by the surface of the large bag; therefore, sudden changes occur in the back pressure when creases occur or disappear. However, according to this aspect of the present invention, the pressure of the liquid in the liquid accommodating chamber is adjusted by deforming the movable film which constitutes only a portion of the walls of the liquid accommodating chamber, and therefore the boundary surface between the liquid accommodating chamber and the gas accommodating chamber is restricted, sudden changes in the back pressure caused by the occurrence or disappearance of creases are prevented, and therefore the pressure is stabilized. Furthermore, it is also possible to prevent the aggregation of the dispersed material in the liquid, at the points where creases occur.

Desirably, the all or a portion of the movable film is constituted by a flexible film having stretch properties or an elastic film having stretch properties.

In this aspect of the invention, since the movable film has stretch properties, then there is no need to limit the range of movement of the movable film in order to prevent the occurrence of creases, and therefore the composition is suitable for achieving large volume of the liquid accommodating chamber.

Desirably, the movable film has a perimeter edge portion which is affixed to the container, and a central portion which is joined to the perimeter edge portion; and the perimeter edge portion has a lower rigidity than the central portion.

To give concrete modes, firstly, there is a mode where the central portion of the movable film is made of a first elastic material, and the perimeter edge portion of the movable film is made of a second elastic material which has a lower spring constant and is more liable to stretch than the first elastic material. Secondly, there is a mode where the central portion of the movable film is made of a rigid material, whereas the perimeter edge portion of the movable film is made of an elastic material. Thirdly, there is a mode where the perimeter edge portion and the central portion of the movable film are made of the same elastic material, and the thickness of the perimeter edge portion of the movable film is made smaller than the thickness of the central portion of the movable film. It is also possible to use a flexible material having stretch properties, instead of an elastic material.

Desirably, the back pressure adjustment apparatus for a liquid ejection head further comprises a stopper member which is provided in the container and restricts a range of movement of the movable film.

In this aspect of the invention, the movable film is prevented from deforming beyond its stress tolerances (beyond its allowable stress), by the stopper member, and therefore damage to the film is avoided.

Desirably, the movable film has a gas permeable portion.

In this aspect of the invention, by employing the movable film not only as a device for back pressure adjustment in the liquid ejection head, but also as a gas separating membrane for deaeration of the ejection liquid, it is possible to deaerate the ejection liquid in the container.

Desirably, the back pressure adjustment apparatus for a liquid ejection head further comprises a heater incorporated with the movable film.

In this aspect of the invention, it is possible to adjust the temperature of the liquid in the liquid accommodating chamber. Furthermore, by heating the liquid during deaeration of the ejection liquid, it is possible to improve the deaeration performance.

According to the present invention, it is possible to provide a back pressure adjustment apparatus which is suited to the supply of large volumes of liquid and is able to stabilize the back pressure variations in the liquid ejection head.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
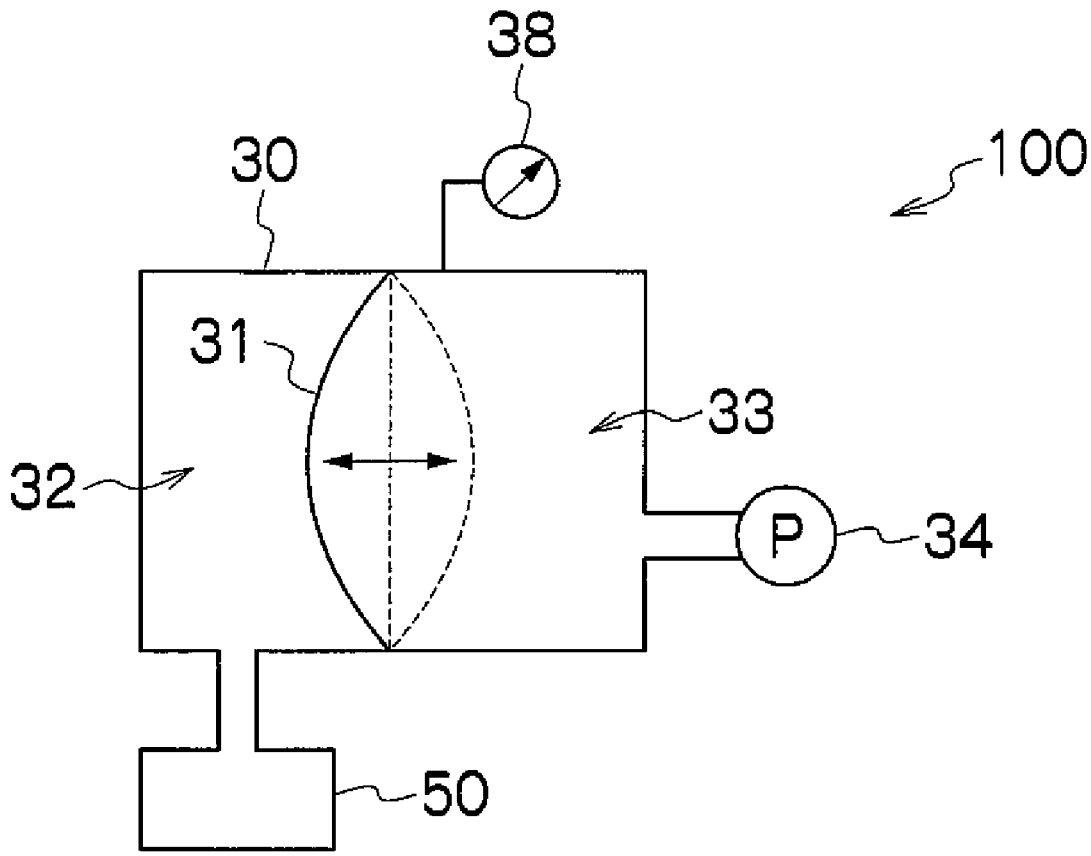
FIG. 1 is a schematic drawing of the basic form of a back pressure adjustment apparatus according to an embodiment of the present invention.

FIG. 1 is a schematic drawing showing the basic composition of a back pressure adjustment apparatus 100 relating to an embodiment of the present invention.

In FIG. 1, a rigid container 30 is divided into a liquid accommodating chamber 32 and a gas accommodating chamber 33 by means of one movable film 31 which is deformable. In other words, the movable film 31 constitutes a barrier which demarcates the rigid container 30 into a liquid accommodating chamber 32 and a gas accommodating chamber 33, and the movable film 31 constitutes a portion of the whole side wall of the liquid accommodating chamber 32, as well as constituting a portion of the whole side wall of the gas accommodating chamber 33.

The liquid accommodating chamber 32 is a chamber which is connected to a liquid ejection head 50, which forms a liquid ejection device for ejecting a prescribed liquid, such as ink, onto a prescribed ejection receiving medium. The liquid accommodating chamber 32 temporarily accommodates liquid to be supplied to the liquid ejection head 50. By adjusting the pressure of the liquid inside the liquid accommodating chamber 32, the pressure of the liquid inside the liquid ejection head 50 is adjusted.

The gas accommodating chamber 33 is a chamber connected to the pressure adjustment pump 34, which forms a pressure adjustment device for adjusting the pressure of the liquid inside the liquid accommodating chamber 32 (in other words, the back pressure of the liquid ejection head 50) by changing the volume of the gas accommodating chamber 33 and the liquid accommodating chamber 32 by causing all or a portion of the movable film 31 to stretch (elongate or contract). The gas accommodating chamber 33 accommodates a prescribed gas, such as air. A pressure sensor 38 is connected to this gas accommodating chamber 33.

The rigid container 30 is a rigid body, and the sum of the volume of the liquid accommodating chamber 32 and the volume of the gas accommodating chamber 33 (in other words, the volume of the rigid container 30) is uniform.

Consequently, if the volume of the gas accommodating chamber 33 increases as the movable film 31 stretches, then the volume of the liquid accommodating chamber 32 decreases by an amount corresponding to the increase in the volume of the gas accommodating chamber 33. On the other hand, if the volume of the gas accommodating chamber 33 decreases as the movable film 31 stretches, then the volume of the liquid accommodating chamber 32 increases by an amount corresponding to the decrease in the volume of the gas accommodating chamber 33. By changing the volume of the liquid accommodating chamber 32 in this way, the pressure of the liquid inside the liquid accommodating chamber 32 is changed. In other words, the back pressure of the liquid ejection head 50 is adjusted.

The movable film 31 is a film-shaped medium which is deformable. Desirably, all or a portion of the movable film 31 is constituted by a flexible film or an elastic film which has stretch properties.

Figure 2A:
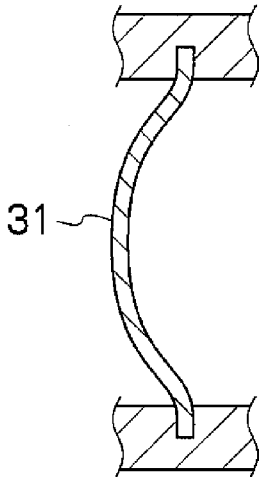
FIG. 2A and FIG. 2C are schematic drawings showing desirable states of a movable film.
Figure 2B:
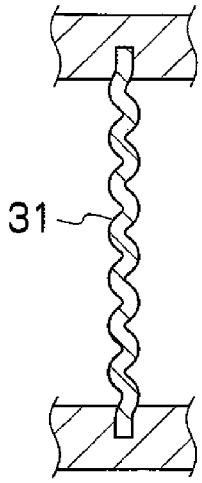
FIG. 2B is a schematic drawing showing a non-desirable state of a movable film.
Figure 2C:
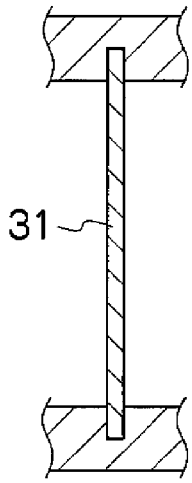

If a flexible film which is non-stretchable is used as the movable film 31, then as shown in FIG. 2A, when the flexion (deflection) is large, creases do not appear in the movable film 31, and therefore, provided that the movable film 31 is used only within this range of large flexion, it is possible to prevent sudden pressure changes caused by the generation or disappearance of creases. If, as shown in FIG. 2B, the flexion is small, then creases occur in the movable film 31, and this means that sudden changes arise in the back pressure. However, by suppressing the occurrence of creases by imparting a strong tension to the movable film 31, it is possible to use the movable film 31 only within a range of small flexion, as shown in FIG. 2C. If a non-stretchable flexible film is used as the movable film 31 in this way, then the movable range of the movable film 31 is small and therefore the back pressure control range is narrowed.

If a flexile film having stretch properties is used as the movable film 31, then as shown in FIG. 2A, creases do not occur when the film has expanded and is in a state of large flexion (deflection), and furthermore, creases do not occur when the film has contracted and is in a state of small flexion, as shown in FIG. 2C. In other words, it is possible to achieve a broad control range for the back pressure, while stabilizing the variation in the back pressure.

It is also possible to use a multiple-layer structure, as the movable film 31. More specifically, it is also possible to use a flexible film inside which liquid or gel is sealed. In this case, the surface area of the movable film 31 changes and the film stretches, as the thickness of the movable film 31 changes.

Below, a case is described in which the movable film 31 has stretch properties.

Figure 3:
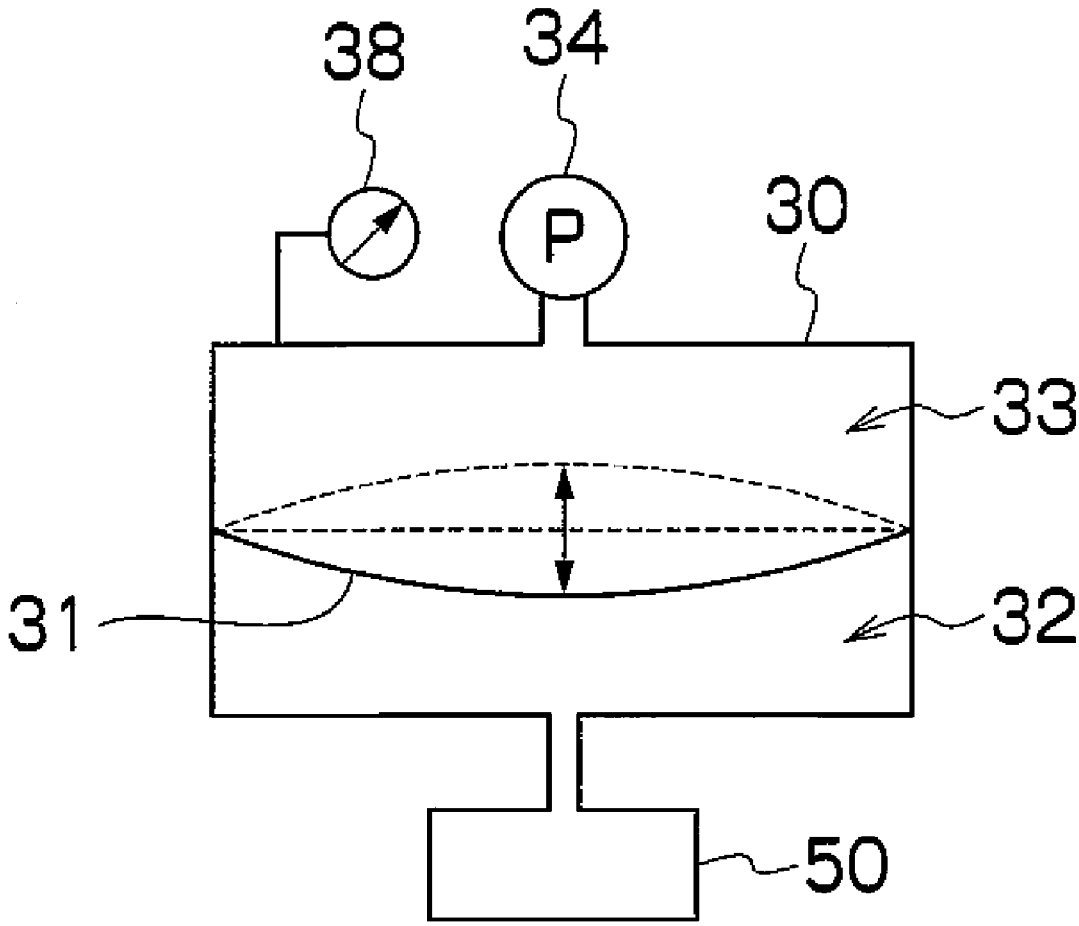
FIG. 3 is a schematic drawing showing a further mode of a back pressure adjustment apparatus according to an embodiment of the present invention.

FIG. 1 shows a case where the movable film 31 is disposed in such a manner that it is aligned in the vertical direction (the direction of the force of gravity) when contracted, but there are no particular restrictions on the direction of orientation of the movable film 31. As shown in FIG. 3, it is also possible to dispose the movable film 31 in such a manner that it is aligned in the horizontal direction (the direction perpendicular to the direction of the force of gravity) when contracted.

Next, various modes of the movable film 31 will be described.

Figure 4:
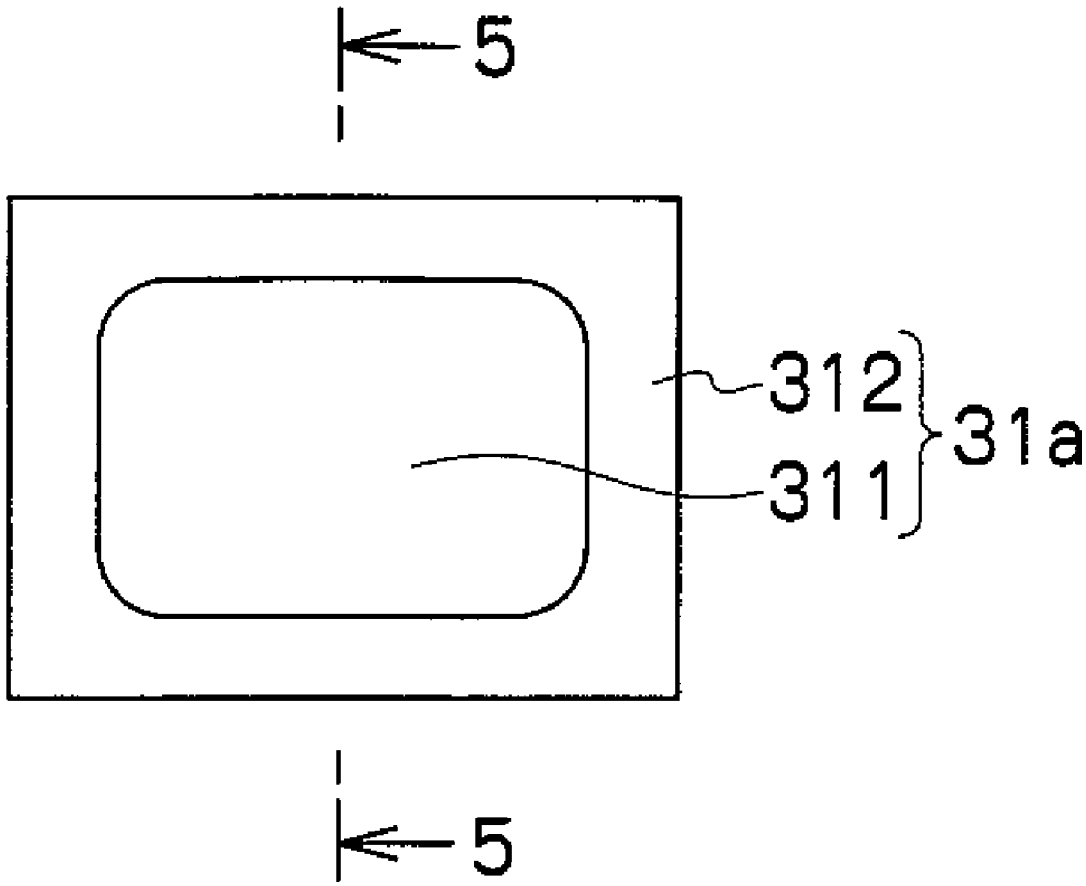
FIG. 4 is a plan diagram showing one example of a movable film according to a first mode.
Figure 5:
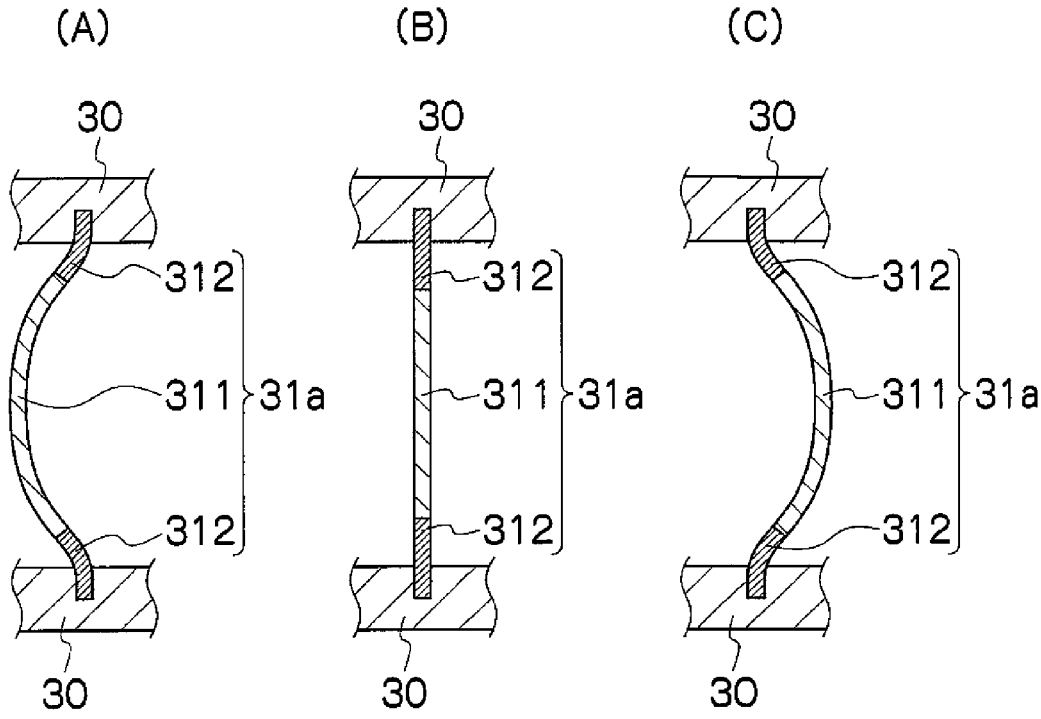
FIG. 5 illustrates cross-sectional diagrams showing one example of the movable film according to the first mode, along line 5-5 in FIG. 4.

FIG. 4 is a plan diagram showing the movable film 31*a* according to a first mode. (A)-(C) in FIG. 5 are cross-sectional views along line 5-5 in FIG. 4 and show states where the movable film is fixed to the rigid container 30. (B) in FIG. 5 shows a state where the movable film 31*a* is contracted to the maximum, and (A) and (C) in FIG. 5 show states where the movable film 31*a* is expanded to the maximum. FIG. 4 shows a case where the movable film 31*a* has a square (quadrangular) planar shape, but the planar shape of the movable film 31*a* is not limited in particular to being a square shape and it may also be a circular shape, an elliptical shape, or the like.

In FIG. 4 and (A)-(C) in FIG. 5, the movable film 31*a* is constituted by a first elastic film 311 disposed in the central portion of the film 31*a*, and a second elastic film 312 disposed in the perimeter edge portion of the movable film 31*a* and affixed to the rigid container 30. The first elastic film 311 and the second elastic film 312 are joined together by bonding, such as thermal welding, ultrasonic welding, or the like.

The second elastic film 312 in the perimeter edge portion has a lower spring constant and is more liable to stretch, than the first elastic film 311 in the central portion. In other words, while the perimeter edge portion of the movable film 31*a* is made of a first elastic material, the central portion of the movable film 31*a* is made of a second elastic material which has a lower spring constant and is more liable to stretch than the first elastic material. The rigidity of the second elastic film 312 in the perimeter edge portion is lower than that of the first elastic film 311 in the central portion. Furthermore, the surface area of the first elastic film 311 in the central portion is greater than the surface area of the elastic film 312 in the perimeter edge portion.

The material of the first elastic film 311 uses an airtight material which is not permeable to air. Concrete examples of the airtight material are described in detail below. If the gas inside the gas accommodating chamber 33 in FIG. 1 passes through the first elastic film 311 which has a large surface area and mixes into the liquid inside the liquid accommodating chamber 32, ejection defects are liable to occur in the liquid ejection head 50, and therefore this passage of air is prevented. The airtight material (for example, resin) which is used as the material of the first elastic film 311 generally has a high rigidity and a large spring constant. On the other hand, the material used for the second elastic film 312 disposed about the periphery of the first elastic film 311 is a material having a lower spring constant and a greater liability to stretch than the first elastic film 311, and if the second elastic film 312 (made, for example, of silicone rubber) has low airtightness, then desirably it is sealed with a highly viscous non-volatile liquid, such as oil, or the like. Provided that this liquid is highly viscous, it is possible to prevent outflow of the liquid.

Figure 6:
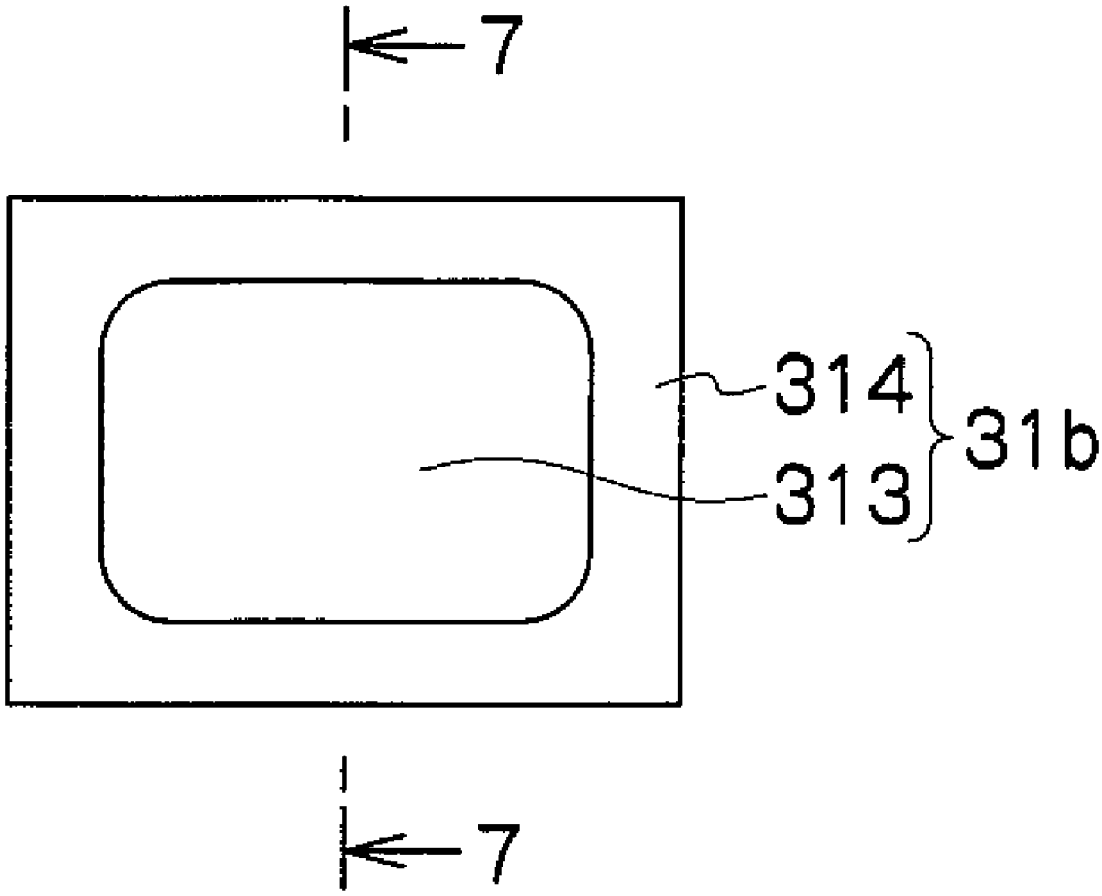
FIG. 6 is a plan diagram showing one example of a movable film according to a second mode.
Figure 7:
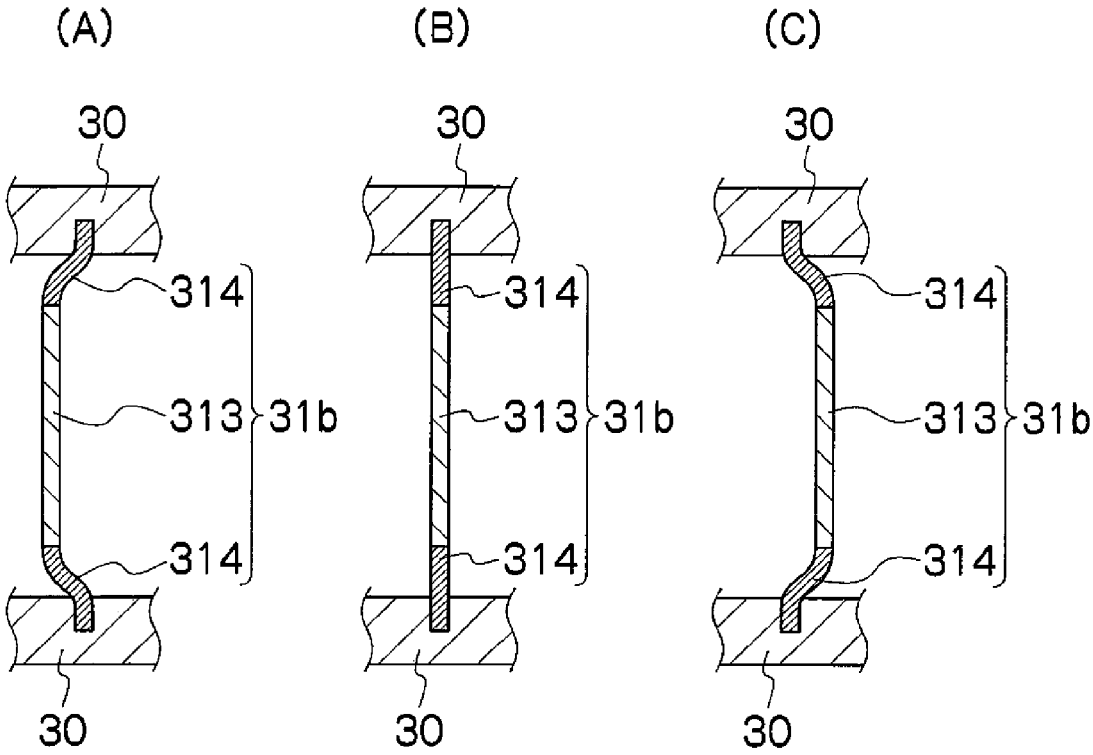
FIG. 7 illustrates cross-sectional diagrams showing one example of the movable film according to the second mode, along line 7-7 in FIG. 6.

FIG. 6 is a plan diagram showing a movable film 31*b* according to a second mode. (A)-(C) in FIG. 7 are cross-sectional views along line 7-7 in FIG. 6 and show states where the movable film is fixed to the rigid container 30. (B) in FIG. 7 shows a state where the movable film 31*b* is contracted to the maximum, and (A) and (C) in FIG. 7 show states where the movable film 31*b* is expanded to the maximum. FIG. 6 shows a case where the movable film 31*b* has a square planar shape, but the planar shape of the movable film 31*b* is not limited in particular to being a square shape and it may also be a circular shape, an elliptical shape, or the like.

In FIG. 6 and (A)-(C) in FIG. 7, the movable film 31*b* is constituted by a rigid film 313 which is disposed in the central portion of the film 31*b*, and an elastic film 314 which is disposed in the perimeter edge portion of the movable film 31*b* and is affixed to the rigid container 30. Consequently, the perimeter edge portion of the movable film 31*b* has lower rigidity than the central portion of the movable film 31*b*. Furthermore, the surface area of the rigid film 313 in the central portion is greater than the surface area of the elastic film 314 in the perimeter edge portion.

The rigid film 313 and the elastic film 314 are connected together by a bonding technique, such as thermal welding, ultrasonic welding, or the like.

The material of the rigid film 313 uses an airtight material which is not permeable to air Concrete examples of the airtight material are described in detail below. If the elastic film 314 (made, for example, of silicone rubber) has low airtightness, then desirably, it is sealed with a highly viscous nonvolatile liquid, or the like.

Figure 8B:
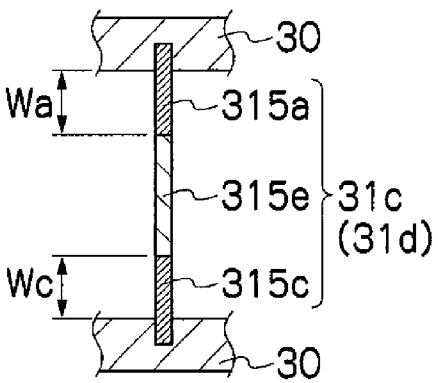
FIGS. 8B and 8C are cross-sectional views of same along line 8B-8B and line 8C-8C in FIG. 5A respectively.
Figure 8A:
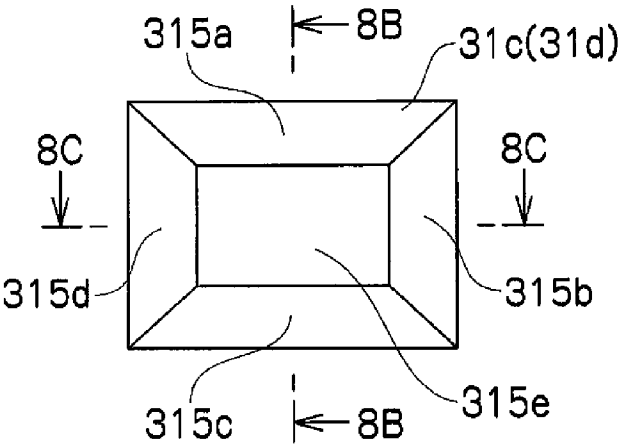
FIG. 8A is a plan diagram showing one example of a movable film according to a third mode.
Figure 8C:
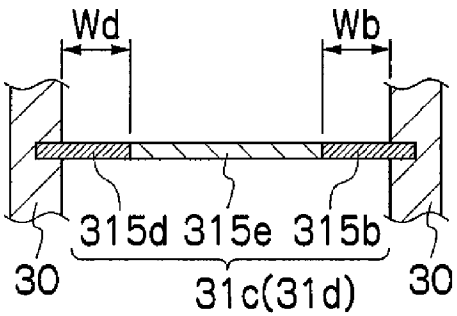

FIG. 8A is a plan diagram showing a movable film 31*c* according to a third mode. FIG. 8B is a cross-sectional view along line 8B-8B in FIG. 8A and shows a state where the movable film 31*c* is affixed to the rigid container 30, and FIG. 5C is a cross-sectional view along line 8C-8C in FIG. 8A and shows a state where the movable film 31*c* is affixed to the rigid container 30. FIG. 8A shows a case where the movable film 31*c* has a square planar shape, but the planar shape of the movable film 31*c* is not limited in particular to being a square shape and it may also be a circular shape, an elliptical shape, or the like.

In FIG. 8A, the movable film 31*c* having longer edges and shorter edges is divided into five regions (a first region 315*a*, a second region 315*b*, a third region 315*c*, a fourth region 315*d*, and a fifth region 315*e*). The perimeter edge portion of the movable film 31*c* is constituted by first to fourth regions 315*a*, 315*b*, 315*c*, 315*d*, and the central portion of the movable film 31*c* is constituted by the fifth region 315*e*.

The first to fifth regions are connected together by bonding, such as thermal welding, ultrasonic welding, or the like.

The spring constant kb of the elastic film which constitutes the second region 315*b* and the spring constant kd of the elastic film which constitutes the fourth region 315*d*, which are disposed along the shorter edges of the movable film 31*c*, are lower than the spring constant ka of the elastic film which constitutes the first region 315*a* and the spring constant kc of the elastic film which constitutes the third region 315*c*, which are disposed along the longer edges of the movable film 31*c*. More specifically, ka=kc>kb=kd. Since the second region 315*b* and the fourth region 315*d* which lie along the shorter edges of the movable film 31*c* are more liable to deform than the first region 315*a* and the third region 315*c* which lie along the longer edges of the movable film 31*c*, then the total amount of deformation of the movable film 31 becomes greater, and this is suitable for achieving a large volume of the liquid accommodating chamber 32.

Here, a case is described in which materials having different spring constants are used for the perimeter edge portion of the movable film 31*c*, but the present invention is not limited in particular to a case of this kind. It is also possible for the widths Wb, Wd of the second region 315*b* and the fourth region 315*d* which are disposed along the shorter edges of the movable film 31*c* to be made smaller than the widths Wa, Wc of the first region 315*a* and the third region 315*c* which are disposed along the longer edges of the movable film 31*c*. In other words, Wa=Wc>Wb=Wd. If a composition of this kind is adopted, then it is possible to form the first to fourth regions 315*a*, 315*b*, 315*c* and 315*d* in the perimeter edge portion, of the same material, and therefore the manufacturing process is simplified and manufacturing costs can be reduced.

Figure 9:
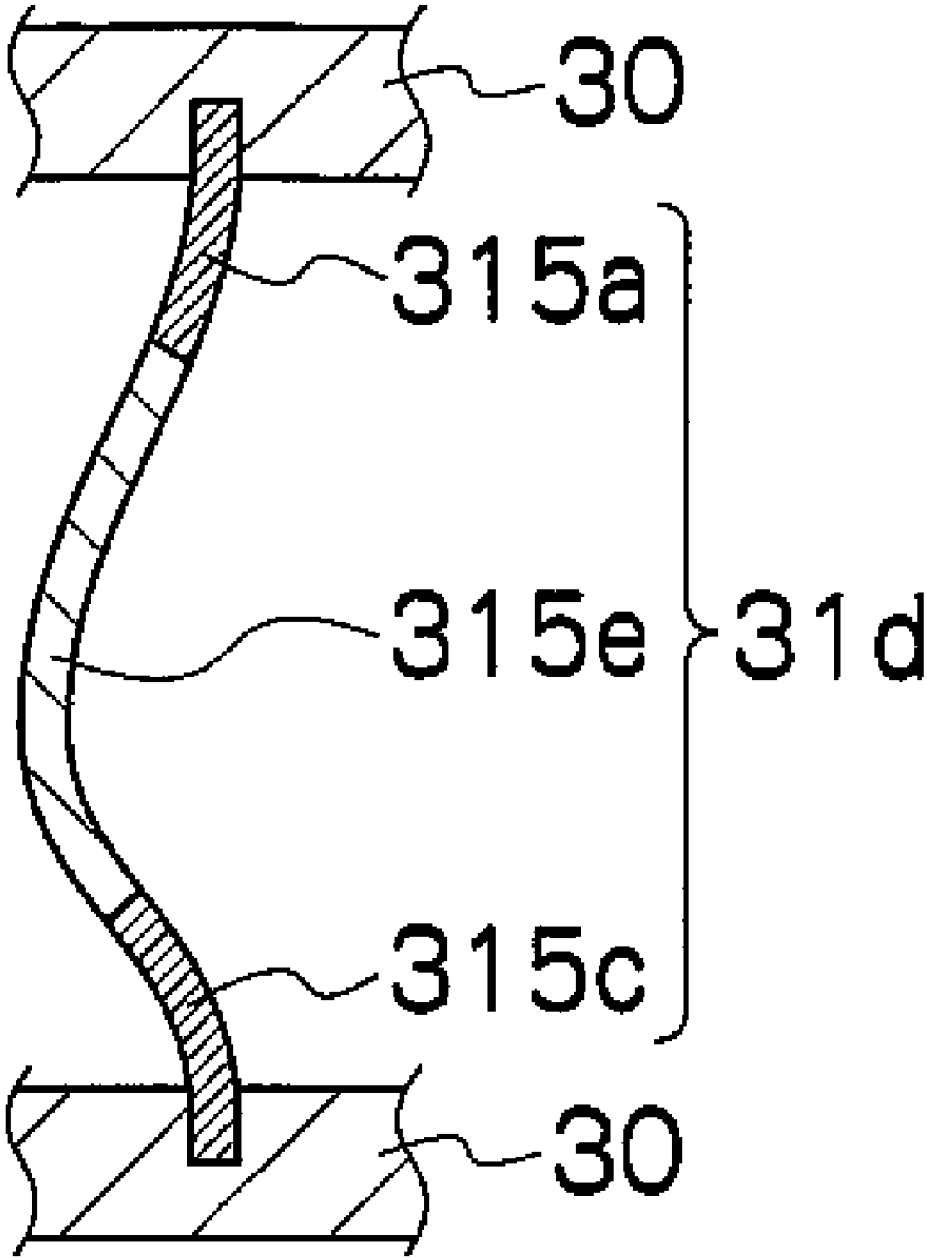
FIG. 9 is a cross-sectional diagram showing one example of a movable film according to a fourth mode.

FIG. 9 is a cross-sectional diagram and shows a movable film 31*d* according to a fourth mode in a state where it is affixed to the rigid container 30. FIG. 9 shows a state where the movable film 31*d* has expanded. The contracted state of the movable film 31*d* is the same as that of the third mode.

In the present mode, in the same manner as the third mode, the spring constant kb of the elastic film which constitutes the second region 315*b* and the spring constant kd of the elastic film which constitutes the fourth region 315*d* are lower than the spring constant ka of the elastic film which constitutes the first region 315*a* and the spring constant kc of the elastic film which constitutes the third region 315*c*. However, in the present mode, in contrast to the third mode, the spring constant kc of the elastic film which constitutes the third region 315*c* and which is disposed on the lower side of the movable film 31 in the vertical direction, is lower than the spring contact ka of the elastic film which constitutes the first region 315*a* and which is disposed on the upper side of the movable film 31 in terms of the vertical direction. In other words, in the present mode, kc<ka<kb=kd By this means, as shown in FIG. 9, the third region 315*c* on the lower side of the movable film 31*d* is more liable to deform than the first region 315*a* on the upper side of the movable film 31*d*, and therefore even if the amount of ink inside the liquid accommodating chamber 32 has become low and the ink has gathered in the downward direction due to the force of gravity, the amount of deformation of the whole of the movable film 31*d* will still be large, and hence this is even more suitable to achieving a large volume of the liquid accommodating chamber 32.

Here, a case is described in which materials having different spring constants are used in the upper edge portion and the lower edge portion of the movable film 31*d*, but the present invention is not limited in particular to a case of this kind. It is also possible to make the width Wc of the third region 315*c* which is disposed on the lower edge of the movable film 31*d* smaller than the width Wa of the first region 315*a* which is disposed on the upper edge of the movable film 31*d*. In other words, Wa>Wc. If a composition of this kind is adopted, then it is possible to form the first region 315*a* and the third region 315*c* in the perimeter edge portion of the same material, and therefore the manufacturing process is simplified and manufacturing costs can be reduced.

Figure 10A:
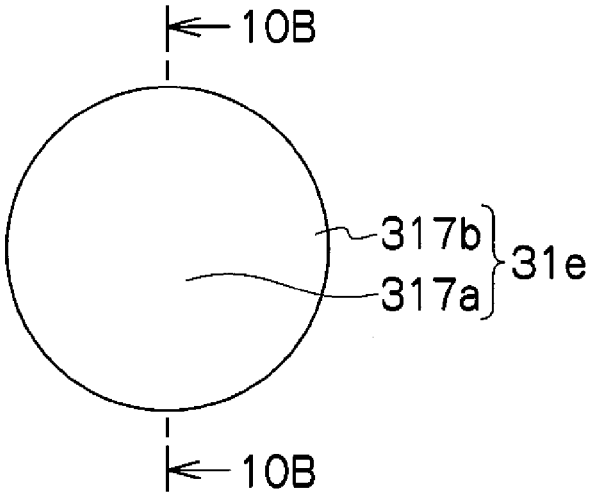
FIG. 10A is a plan diagram showing one example of a movable film according to a fifth mode.
Figure 10B:
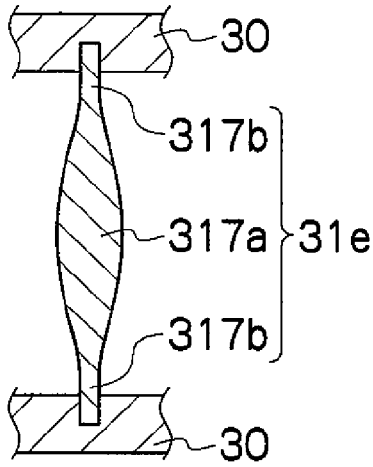
FIG. 10B is a cross-sectional view of same along line 10B-10B in FIG. 10A.

FIG. 10A is a plan diagram showing a movable film 31*e* according to a fifth mode. FIG. 10B is a cross-sectional view along line 10B-10B in FIG. 10A and shows a state where the movable film 31*e* is fixed to the rigid container 30. FIG. 10A shows a case where the movable film 31*e* has a circular planar shape, but the planar shape of the movable film 31*e* is not limited in particular to being a circular shape and it may also be an elliptical shape, a square shape, or the like.

In FIGS. 10A and 10B, the central portion 317*a* and the perimeter edge portion 317*b* of the movable film 31*e* are constituted by the same elastic material (or of the same flexible material having stretch properties). In the movable film 31*e* according to the present mode, the thickness of the central portion 317*a* is greater than the thickness of the perimeter edge portion 317*b*, like a lens. In other words, the thickness of the perimeter edge portion 317*b* is smaller than the thickness of the central portion 317*a*.

Figure 11A:
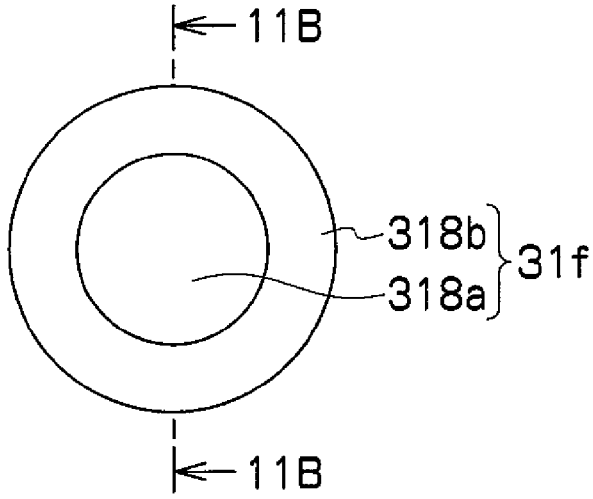
FIG. 11A is a plan diagram showing one example of a movable film according to a sixth mode.
Figure 11B:
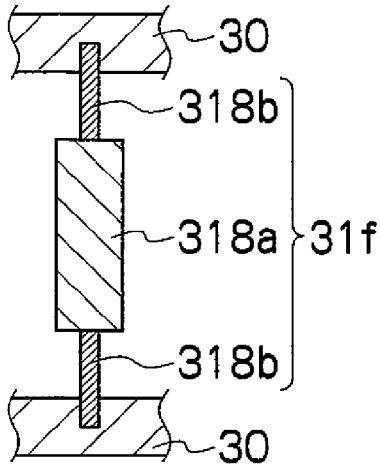
FIG. 11B is a cross-sectional view of same along line 11B-11B in FIG. 11A.

FIG. 11A is a plan diagram showing a movable film 31*f* according to a sixth mode. FIG. 11B is a cross-sectional view along line 11B-11B in FIG. 11A and shows a state where the movable film 31*f* is fixed to the rigid container 30. FIG. 11A shows a case where the movable film 31*f* has a circular planar shape, but the planar shape of the movable film 31*f* is not limited in particular to being a circular shape and it may also be an elliptical shape, a square shape, or the like.

In FIGS. 11A and 11B, the central portion 318*a* and the perimeter edge portion 318*b* of the movable film 31*f* are made of the same elastic material (or of the same flexible material having stretch properties). The thickness of the central portion 318*a* is greater than the thickness of the perimeter edge portion 318*b*. In this way, it is possible for the movable film 31*f* to have a shape other than a lens shape.

Figure 12A:
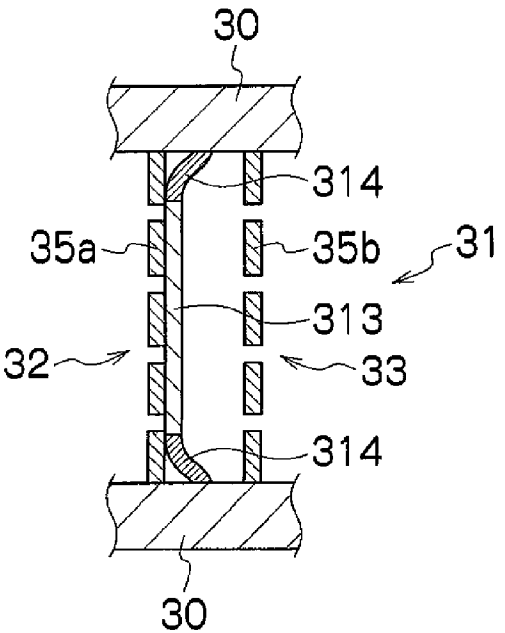
FIGS. 12A to 12C are cross-sectional diagrams showing the principal part of a container formed with stopper members.
Figure 12B:
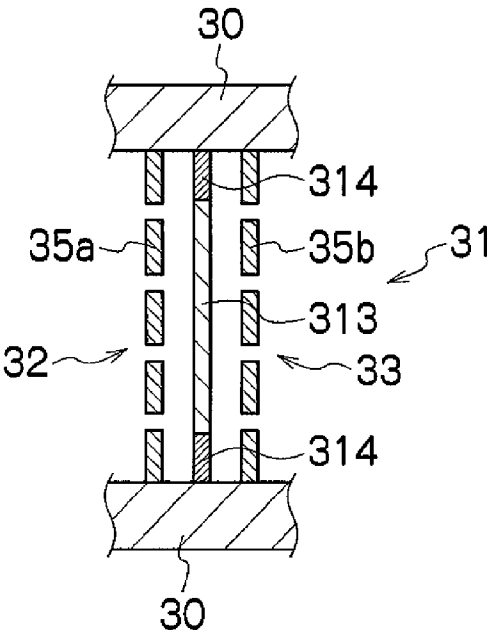
Figure 12C:
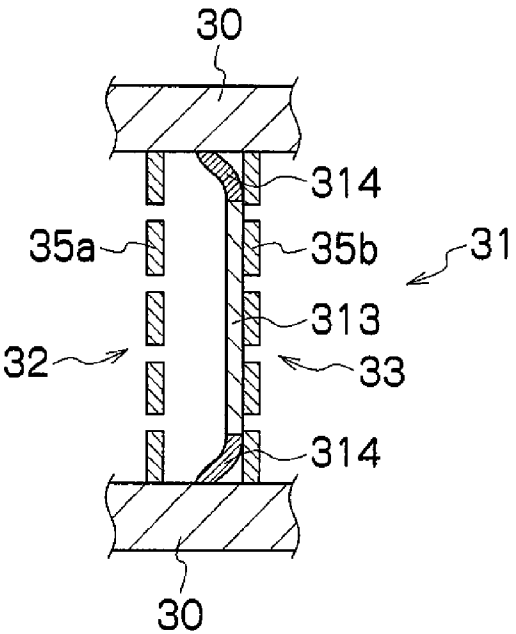

The cross-sectional diagrams in FIGS. 12A to 12C show the principal part of the rigid container 30 formed with stopper members 35 (35*a*, 35*b*). FIG. 12B shows a state where the movable film 31 is contracted to the maximum, and FIGS.

12A and 12C show states where the movable film 31*a* is expanded to the maximum. The movable film 31 shown in FIGS. 12A to 12C relates to an example where the movable film 31*b* of the second mode shown in FIG. 6 and (A)-(C) in FIG. 7 is used, and elements which are the same as the movable film 31*b* of this second mode are labeled with the same reference numerals and the contents which have already been described are not explained further here.

The stopper members 35 (35*a*, 35*b*) which restrict the movable range of the movable film are provided on either side of the movable film 31. More specifically, as shown in FIG. 12A, if the movable film 31 (in the present embodiment, the rigid film 313 thereof) abuts against the first stopper member 35*a* which is disposed on the liquid accommodating chamber 32 side of the rigid container 30, then the position of the movable film 31 when the movable film 31 deforms to the maximum toward the side of the liquid accommodating chamber 32 is restricted. FIG. 12B shows a state where the movable film 31 is not abutting against the stopper members 35, in other words, a state where the movable film 31 is within the movable range. Furthermore, as shown in FIG. 12C, the position of the movable film 31 when the movable film 31 deforms to the maximum toward the side of the gas accommodating chamber 33 is restricted, if the movable film 31 (in the present embodiment, the rigid film 313 thereof) abuts against the second stopper member 35*b* which is disposed on the gas accommodating chamber 33 side of the rigid container 30.

Figure 13A:
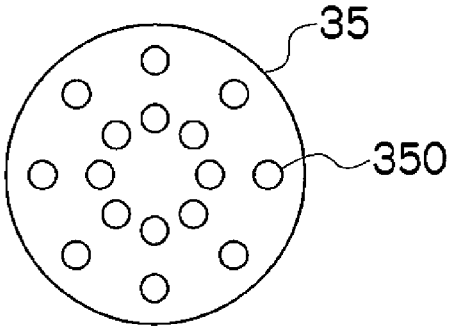
FIGS. 13A and 13B are plan diagrams of examples of the stopper member.

FIG. 13A is a plan diagram of one example of the stopper member 35. A plurality of holes 350 are opened in the stopper member 35 in such a manner that liquid or gas is able to pass freely through these holes 350, and furthermore, the movement range of the movable film 31 is restricted physically when the movable film 31 abuts against the peripheral regions about the holes 350.

Figure 13B:
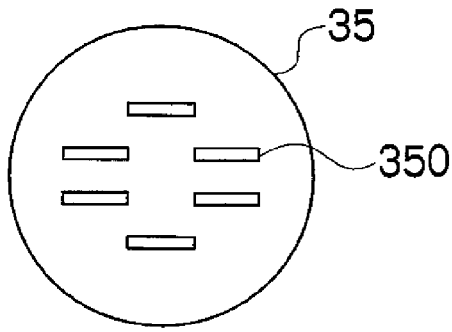

For example, the circular holes 350 having a diameter of approximately 1 to 50 mm are disposed on the whole or a portion of the surface of the stopper member 35. The shape of the holes 350 in the stopper members 35 is not limited in particular to a circular shape, and provided that holes having a substantially similar surface area are formed, it is also possible, for example, to adopt square-shaped holes 350 as shown in FIG. 13B.

If the holes 350 in the stopper member 35 have a large opening surface area and the portion of the movable film 31 which abuts against the stopper member 35 has low elasticity, then there is a possibility that the movable film 31 may enter inside the holes 350 in the stopper member 35. Therefore, the surface area of the openings of the holes 350 in the stopper member 35 is set to a surface area which prevents the movable film 31 from entering thereinto.

Furthermore, it is desirable that the material of the stopper member 35 should have higher rigidity than the movable film 31. If the liquid is an ink, then it must have ink-resistant properties, and therefore, in general, an ink-resistant metal plate made of stainless steel, or the like, or a ceramic plate, is used as the stopper member 35. There are no particular restrictions on the thickness of the stopper member 35, but, as an example, a plate having a thickness of approximately 0.1 to 2 mm is used.

Even if the movable film 31 receives a force equal to or exceeding its own allowable stress tolerances due to pressure change, the presence of the stopper members 35 prevents damage to the movable film 31. For example, if the pressure sensor (reference numeral 38 in FIG. 1) is defective or broken, there is a possibility that the movable film 31 will move significantly from a normal position. In extreme situations of this kind, damage to the movable film 31 is prevented by means of the stopper members 35 restricting the range of movement of the movable film 31.

Furthermore, the stopper members 35 also have an efficient action during pressurized purging, where dummy ejection is performed by pressurizing the ink inside the liquid ejection head 50. In pressurized purging, there is a possibility that extremely large pressure changes may occur within a very short time inside the liquid accommodating chamber 32, in comparison with suction-based purging which suctions ink from the nozzles (reference numeral 51 in FIGS. 15A and 15B) of the liquid ejection head 50. For example, in order to carry out pressurized purging, the pressure is raised to one atmosphere above the atmospheric pressure, and when the meniscus in the nozzles of the liquid ejection head 50 breaks down, the pressure returns instantaneously to the atmospheric pressure. In the present embodiment, since the stopper members 35 restrict the movement range of the movable film 31, then the movable film 31 is restricted from performing any movements beyond the necessary, and there is no breakage of the movable film 31. Furthermore, since the movement of the movable film 31 is halted when the movable film 31 abuts against the stopper member 35, then the supply of ink to the liquid ejection head 50 is halted, and hence a beneficial effect is obtained in that surplus ink is prevented from flowing out from the nozzles of the liquid ejection head 50.

In FIGS. 12A to 12C, stopper members 35 are provided on both the liquid accommodating chamber 32 side and the gas accommodating chamber 33 side of the rigid container 30, but if the inner wall of the rigid container 30 (the inner wall of the gas accommodating chamber 33 or the inner wall of the liquid accommodating chamber 32) is used as one of the stopper members 35, then it is possible to omit one of the stopper members 35. For example, the movable film 31 is disposed toward the side of the gas accommodating chamber 33 in the rigid container 30, and hence the inner wall on the gas accommodating chamber 33 side of the rigid container 30 is used as a stopper member, and a stopper member is only provided on the liquid accommodating chamber 32 side of the rigid container 30.

Figure 14:
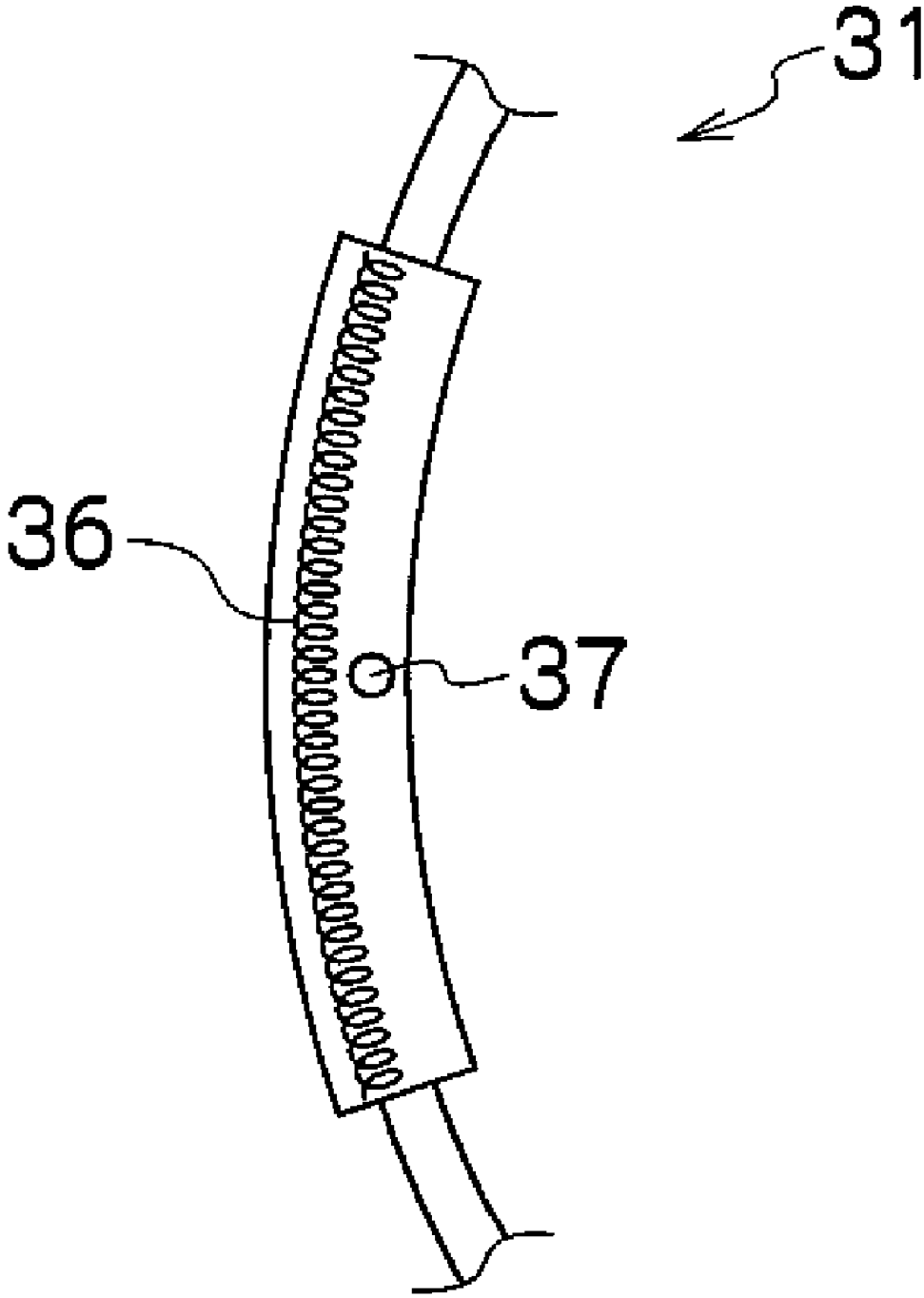
FIG. 14 is a cross-sectional diagram showing a movable film having a heater incorporated therein.

FIG. 14 is a cross-sectional diagram showing the principal part of a movable film 31 which has a heater 36 (electric heater) incorporated therein. The ink inside the liquid accommodating chamber 32 of the rigid container 30 can be heated via the movable film 31, by means of this heater 36. In FIG. 14, the wiring of the heater 36 is omitted from the drawing.

By raising the vacuum level of the gas accommodating chamber 33 of the rigid container 30 by using the pressure adjustment pump 34 in FIG. 1, it is possible to remove dissolved gas from the ink inside the liquid accommodating chamber 32 of the rigid container 30 (namely, to perform deaeration), via the movable film 31. The movable film 31 has a gas permeable portion and the gas is able to pass through this gas permeable portion.

In FIG. 14, the stopper members 35 which are depicted in FIGS. 12A to 12C are not illustrated, but since the level of vacuum in the gas accommodating chamber 33 is higher during deaeration of the ink, then it is desirable that stopper members 35 should be provided in order to prevent breakage of the movable film 31. Since the heater 36 is provided inside the movable film 31, then the ink in the vicinity of the movable film 31 produces bubbles and is deaerated efficiently.

The heater 36 inside the movable film 31 has a structure in which a resistance wire is embedded inside a heat-resistant material, such as silicone rubber, fluorine rubber, or polyimide (PI) resin, for example. More desirably, a temperature sensor 37 which determines the temperature is embedded inside the movable film 31, together with the heater 36, since this enables highly accurate determination of the temperature.

The application of the heater 36 is not limited to the deaeration of ink, and the heater 36 may also be used to adjust the temperature of the ink inside the liquid accommodating chamber 32. Since the structure is adopted in which the heater 36 and the ink inside the liquid accommodating chamber 32 lie in close proximity via the surface layer of the movable film 31, then it is possible directly to heat the material for heating, and therefore highly efficient temperature adjustment is possible. Furthermore, by adjusting the temperature of the ink in the sub tank 30 which is located closely to the liquid ejection head 50, it is possible to reduce any fall in the temperature of ink, in comparison with a case where the temperature of the ink is adjusted in the upstream side of the sub tank 30, and therefore excellent energy efficiency is achieved.

Next the material of the movable film 31 will be described in detail.

It is also possible to use a film of organic material for the airtight material of the movable film 31. The film of organic material having airtight properties (gas barrier properties) with respect to oxygen may be, for example, PVDC polyvinylidene chloride), EVOH (ethylene/vinyl alcohol copolymer), PAN (polyacryl nitrile), or the like.

However, a single-layer film may have poor liquid resistance and therefore a multiple-layer film is desirably used. For example, if EVOH, which has high water absorption, is formed as a single layer, then the film will swell and deform, and therefore it is desirable to adopt a structure in which PE (polyethylene) is disposed on either surface of the film, in order to protect the EVOH. Here, the film thickness is, for example, approximately 10 to 50 μm in the EVOH layer, and approximately 30 to 300 μm in the PE on either surface, the layers being designed in accordance with the required flexibility.

Furthermore, a metal vapor deposition film is used as the airtight material of the movable film 31. For example, a metal having low rigidity, such as aluminum (Al), gold, silver, or the like, is used. For instance, a multiple-layer metal vapor deposition film formed with LDPE (low-density polyethylene) is used on either surface of the Al vapor deposition film. Here, the film thickness is, for example, approximately 2 to 15 μm in the Al film and approximately 30 to 300 μm in the PE layers on either surface. In general, a metal film having a thickness of approximately 10 nm has the capacity to shut out gas, which means that the film thickness can be reduced greatly compared to a case where an organic material is used. However, in the case of a metal film formed by vapor deposition, pinholes are liable to occur, and gas leaks out via the pinholes, and therefore, in order to prevent this gas leakage, the film thickness is increased. It is desirable that the metal portion should be formed as thinly as possible, in order to maintain the flexibility of the film, and therefore it is desirable to deposit the metal film by sputtering. In this case, the film thickness is approximately 10 nm to 100 nm, the film is able to deform readily, and therefore stable pressure control becomes possible. If a single-layer metal film is adopted, then stainless steel is used, for example. The film thickness is approximately 3 to 15 μm, for example.

Figure 15A:
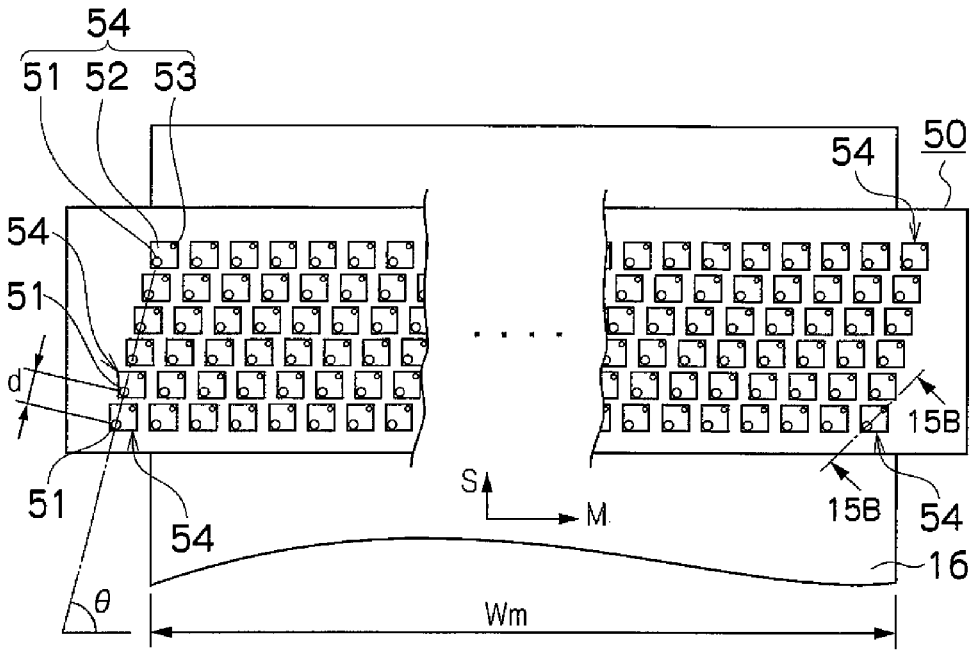
FIG. 15A is a general schematic drawing of one example of a liquid ejection head and FIG. 15B is a cross-sectional view of same along line 15B-15B in FIG. 15A.

FIG. 15A is a plan view perspective diagram showing the general composition of one example of the liquid ejection head 50.

The liquid ejection head 50 shown as an example in FIG. 15A is a so-called full line liquid ejection head, having a structure in which a plurality of nozzles 51 (liquid ejection ports) which eject droplets of ink toward a medium 16 are arranged in a two-dimensional configuration through a length corresponding to the width Wm of the ejection receiving medium 16 in the direction perpendicular to the direction of conveyance of the ejection receiving medium 16 (the sub-scanning direction indicated by arrow S in FIG. 15A), in other words, in the main scanning direction indicated by arrow M in FIG. 15A.

The liquid ejection head 50 comprises a plurality of liquid ejection elements 54, each comprising a nozzle 51 which ejects liquid, a pressure chamber 52 connected to the corresponding nozzle 51, and a liquid supply port 53 for supplying liquid to the corresponding pressure chamber 52, the recording elements 54 being arranged in two directions, namely, a main scanning direction M and an oblique direction forming a prescribed acute angle θ (where 0° C.<θ<90°) with respect to the main scanning direction M. In FIG. 15A, in order to simplify the drawing, only a portion of the liquid ejection elements 54 is depicted in the drawing.

In specific terms, the nozzles 51 are arranged at a uniform pitch d in the direction forming a prescribed acute angle of θ with respect to the main scanning direction M, and hence the nozzle arrangement can be treated as equivalent to a configuration in which nozzles are arranged at an interval of d×cos θ in a single straight line following the main scanning direction M.

Figure 15B:
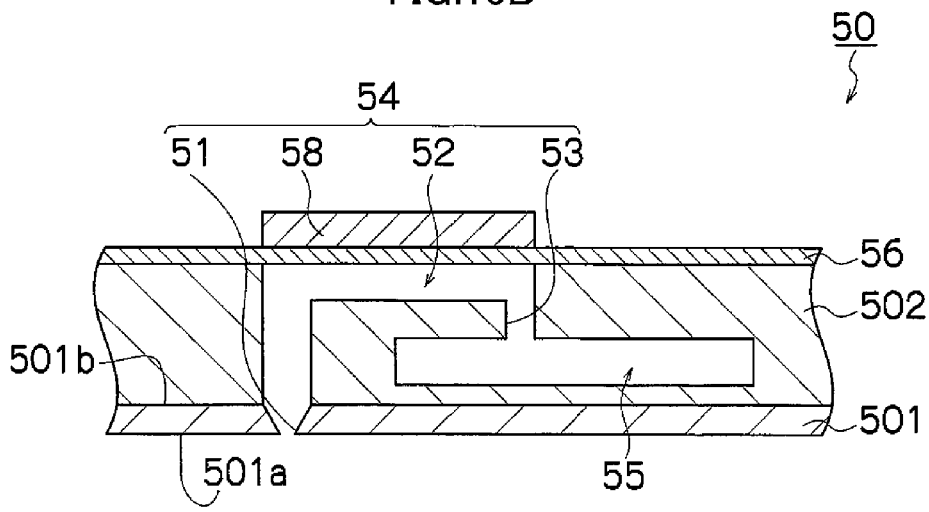

Furthermore, FIG. 15B shows a cross-sectional diagram along line B-B in FIG. 15A.

In FIG. 15B, the liquid ejection head 50 comprises nozzles 51 which eject liquid, pressure chambers 52 which are connected to the nozzles 51 and into which liquid is filled, liquid supply ports 53 for supplying liquid to the pressure chambers 52, a common flow channel 55 which is connected to the pressure chambers 52 via the liquid supply ports 53, and piezoelectric elements 58 which form actuators for changing the pressure inside the pressure chambers 52.

FIG. 15B shows only one liquid ejection element 54, in order to simplify the illustration, but the liquid ejection head 50 actually is constituted by the plurality of liquid ejection elements 54 which are arranged in a two-dimensional configuration as shown in FIG. 15A. More specifically, each liquid ejection element 54 comprises one nozzle 51, one pressure chamber 52, one liquid supply port 53, and one piezoelectric element 58. In other words, in practice, the liquid ejection head 50 comprises a plurality of nozzles 51, a plurality of pressure chambers 52, a plurality of liquid supply ports 53 and a plurality of piezoelectric elements 58.

The liquid ejection head 50 is composed by bonding a nozzle plate 501 formed with nozzles 51 to a pressure chamber plate 502 in which pressure chambers 52 and the like are formed. In other words, one surface of the nozzle plate 501 forms a liquid ejection surface 501*a* in which nozzles 51 are arranged in a two-dimensional configuration as shown in FIG. 15A, and the other surface of the nozzle plate 501 forms a bonding surface 501*b* which is bonded to the pressure chamber plate 502. The pressure chambers 52, the liquid supply ports 53 and the common flow channel 55 are formed in the pressure chamber plate 502. A diaphragm 56 is bonded to the surface of the pressure chamber plate 502 on the opposite side to the bonding surface 501*b* with the nozzle plate 501, and this diaphragm 56 constitutes a ceiling plate of the pressure chambers 52. The piezoelectric elements 58 are formed on the diaphragm 56.

The rigid container 30 of the back pressure adjustment apparatus 100 shown in FIG. 1 is connected to the common flow channel 55 of the liquid ejection head 50 of this kind. Hereinafter, the rigid container 30 is called the "sub tank".

Figure 16:
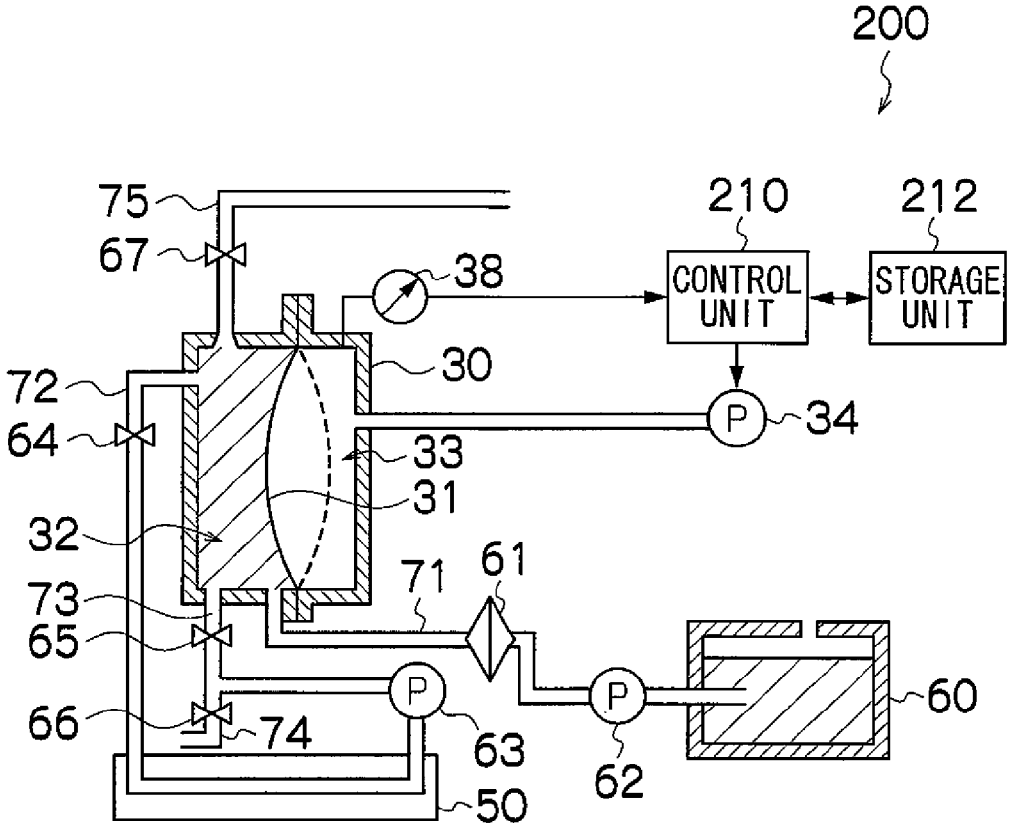
FIG. 16 is a general schematic drawing of a liquid ejection apparatus to which an embodiment of the present invention is applied.

FIG. 16 shows the principal composition of a liquid ejection apparatus 200 to which the back pressure adjustment apparatus 100 in FIG. 1 is applied.

In FIG. 16, the liquid ejection apparatus 200 principally comprises a sub tank 30 (rigid container), a pressure adjustment pump 34, a pressure sensor 38, a liquid ejection head 50, a main tank 60, a filter 61, a supply pump 62, a circulation pump 63, a supply flow channel opening and closing valve 64, a circulation flow channel opening and closing valve 65, an expulsion flow channel opening and closing valve 66, a gas bubble removal valve 67, a control unit 210 and a storage unit 212.

The main tank 60 is a tank forming a supply source of ink. The supply pump 62 for supplying the ink inside the main tank 60 to the liquid ejection head 50 via the interior of the liquid accommodating chamber 32 of the sub tank 30, and the filter 61 which removes the foreign matter in the ink inside the first supply flow channel 71, are provided in a first supply flow channel 71 which leads from the main tank 60 to the liquid accommodating chamber 32 of the sub tank 30. The pressure sensor 38 which determines the pressure of the gas inside the gas accommodating chamber 33 is formed with the gas accommodating chamber 33 of the sub tank 30. The supply flow channel opening and closing valve 64 which opens and closes a second supply flow channel 72, leading from the liquid accommodating chamber 32 of the sub tank 30 to the liquid ejection head 50, is provided in the second supply flow channel 72. The circulation pump 63 for circulating the ink between the liquid ejection head 50 and the liquid accommodating chamber 32 of the sub tank 30, and the circulation flow channel opening and closing valve 65 which opens and closes a circulation flow channel 73 leading from the liquid ejection head 50 to the liquid accommodating chamber 32 of the sub tank 30, are provided in the circulation flow channel 73. The expulsion flow channel opening and closing valve 66 which opens and closes an expulsion flow channel 74 for expelling liquid from inside the liquid ejection head is provided in the expulsion flow channel 74. The gas bubble removal valve 67 which opens and closes a gas bubble removal tube 75 for removing gas bubbles from inside the liquid accommodating chamber 32 of the sub tank 30 is provided in the air bubble removal tube 75.

The control unit 210 is constituted by a CPU and peripheral circuits of same, and controls sections of the liquid ejection apparatus 200, such as the pressure adjustment pump 34, the liquid ejection head 50, the supply pump 62, the circulation pump 63, the supply flow channel opening and closing valve 64, the circulation flow channel opening and closing valve 65, the expulsion flow channel opening and closing valve 66, the gas bubble removal valve 67, and the like. Furthermore, the control section 210 adjusts the pressure of the liquid inside the liquid accommodating chamber 32 of the sub tank 30 on the basis of the output signals from the pressure sensor 38, by changing the volume of the gas accommodating chamber 33 in the sub tank 30 and causing the movable film 31 in the sub tank 30 to deform, by using the pressure adjustment pump 34. In other words, the control unit 210 adjusts the pressure of the liquid inside the liquid accommodating chamber 32 of the sub tank 30 (in other words, the back pressure of the liquid ejection head 50), by adjusting the pressure of the gas inside the gas accommodating chamber 33 of the sub tank 30 as determined by the pressure sensor 38 (the gas inside the gas accommodating chamber 33 is treated like the pressure of the liquid inside the liquid accommodating chamber 32). The pressure sensor may be formed with the liquid accommodating chamber 32 of the sub tank 30, in such a manner that the back pressure of the liquid ejection head 50 is adjusted on the basis of the output signals from this pressure sensor.

The storage unit 212 stores programs that are executed by the control unit 210, and various types of information required for the execution of these programs.

Figure 17:
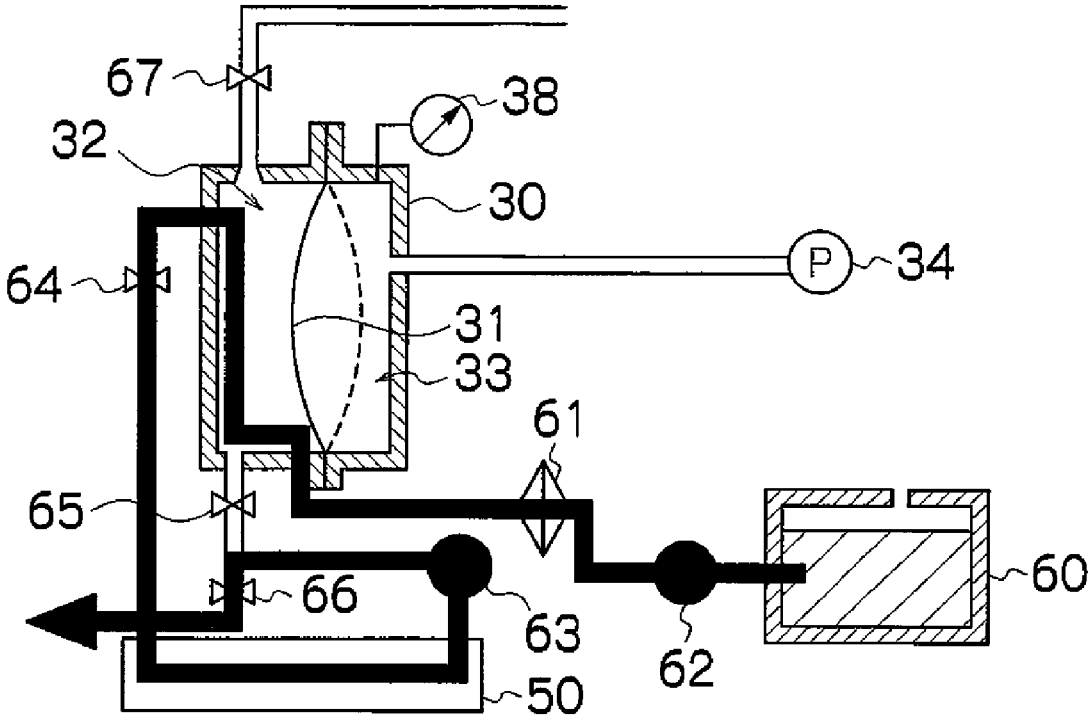
FIG. 17 is an illustrative diagram used to describe an initial filling process in the liquid ejection apparatus.

Upon initial filling, as shown in FIG. 17, the supply flow channel opening and closing valve 64 is opened, the circulation flow channel opening and closing valve 65 is closed, the expulsion flow channel opening and closing valve 66 is opened and the gas bubble removal valve 67 is closed, and furthermore, the supply pump 62 and the circulation pump 63 are driven. By this means, the ink inside the main tank 60 is supplied to the liquid accommodating chamber 32 of the sub tank 30 via the filter 61, and furthermore, the ink inside the liquid accommodating chamber 32 of the sub tank 30 is supplied to the liquid ejection head 50, and the ink containing gas bubbles inside the liquid ejection head 50 is expelled.

Figure 18A:
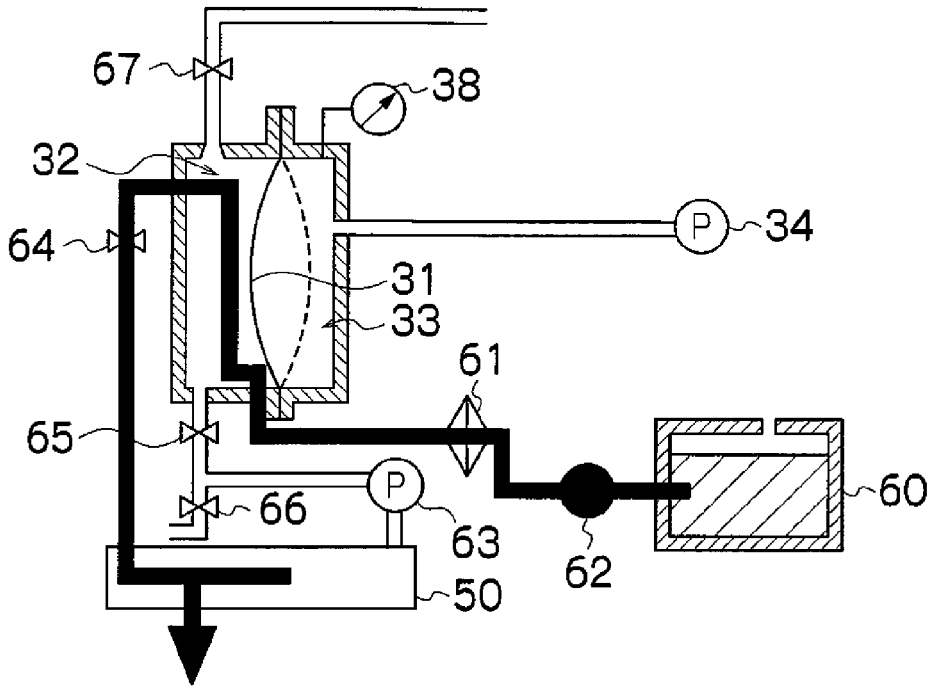
FIGS. 18A and 18B are illustrative diagrams used to describe a state during a printing process in the liquid ejection apparatus.

Normally, during printing, as shown in FIG. 18A, the supply flow channel opening and closing valve 64 is opened, the circulation flow channel opening and closing valve 65 is closed, the expulsion flow channel opening and closing valve 66 is closed and the gas bubble removal valve 67 is closed, and furthermore, the supply pump 62 is driven. By this means, the ink inside the main tank 60 is supplied to the liquid accommodating chamber 32 of the sub tank 30 via the filter 61, and furthermore, the ink inside the liquid accommodating chamber 32 of the sub tank 30 is supplied to the liquid ejection head 50.

Figure 18B:
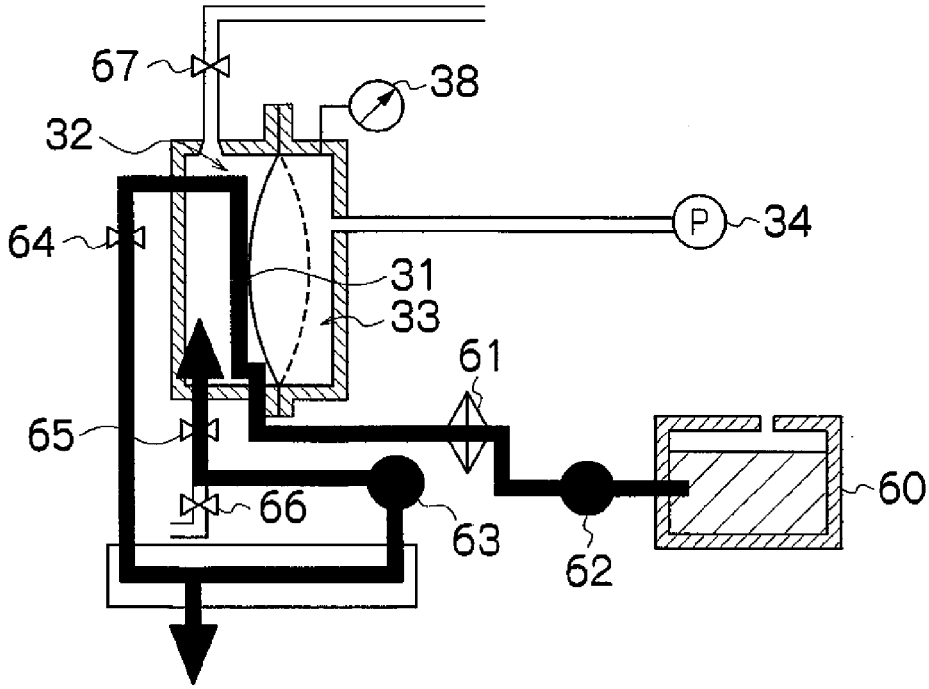

Alternatively, the following may be possible: during printing, as shown in FIG. 18B, the supply flow channel opening and closing valve 64 is opened, the circulation flow channel opening and closing valve 65 is opened, the expulsion flow channel opening and closing valve 66 is closed and the gas bubble removal valve 67 is closed, and furthermore, both the supply pump 62 and the circulation pump 63 are driven. By this means, the ink inside the main tank 60 is supplied to the liquid accommodating chamber 32 of the sub tank 30 via the filter 61, and furthermore, the ink inside the liquid accommodating chamber 32 of the sub tank 30 is supplied to the liquid ejection head 50, and the surplus ink inside the liquid ejection head 50 is circulated to the liquid accommodating chamber 32 of the sub tank 30.

Figure 19A:
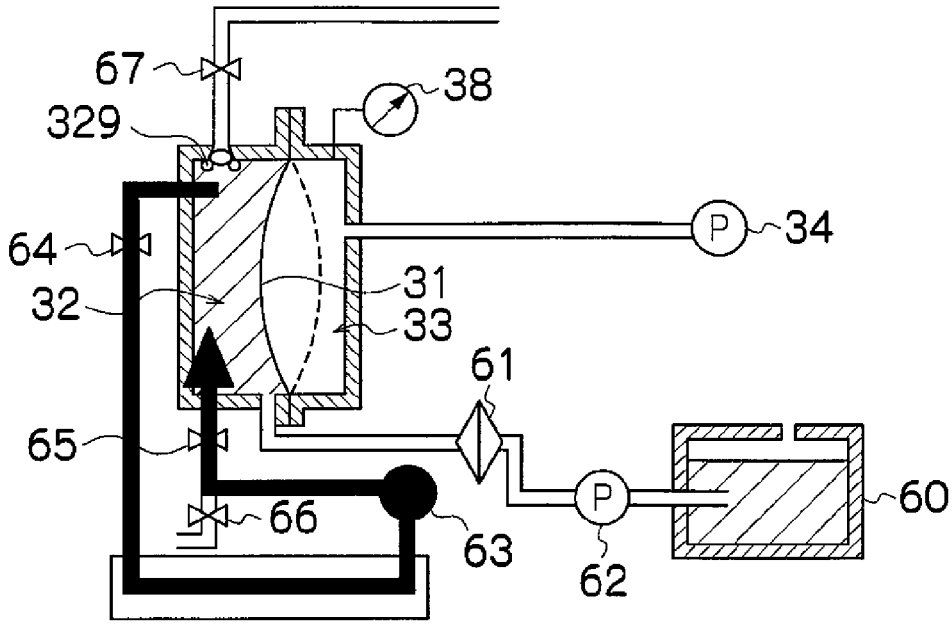
FIGS. 19A and 19B are illustrative diagrams used to describe a gas bubble removal process in the liquid ejection apparatus.
Figure 19B:
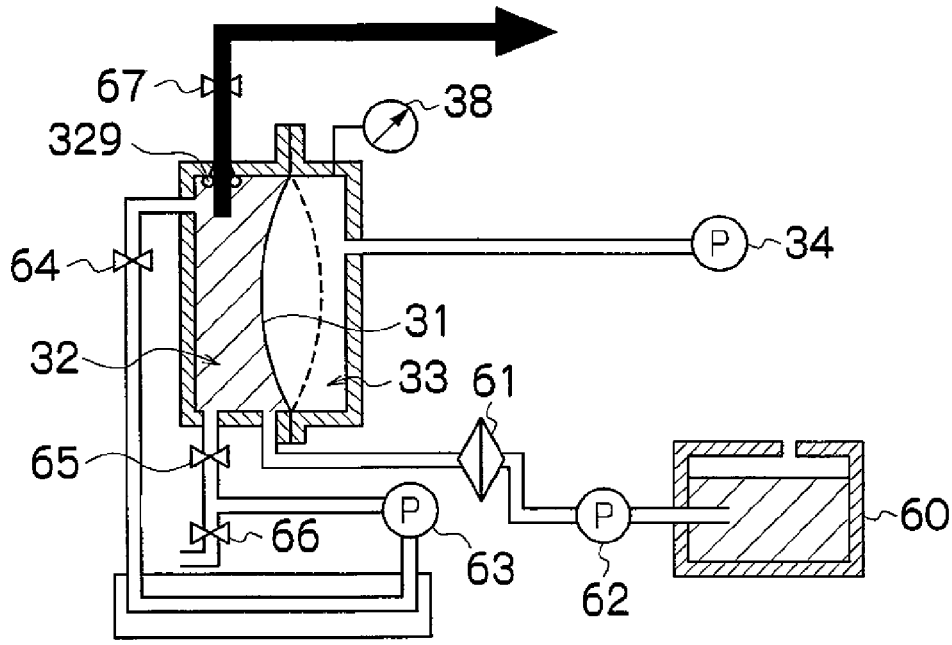

During the removal of gas bubbles, firstly, as shown in FIG. 19A, the supply flow channel opening and closing valve 64 is opened, the circulation flow channel opening and closing valve 65 is opened, the expulsion flow channel opening and closing valve 66 is closed and the gas bubble removal valve 67 is closed, and furthermore, the supply pump 62 is set to a halted state while the circulation pump 63 is driven. By this means, firstly, ink is circulated between the interior of the liquid accommodating chamber 32 of the sub tank 30 and the liquid ejection head 50. In so doing, the gas bubbles 329 collect in the upper end of the liquid accommodating chamber 32 of the sub tank 30. Thereupon, as shown in FIG. 19B, the driving of the circulation pump 63 is halted, the supply flow channel opening and closing valve 64 is closed, the circulation flow channel opening and closing valve 65 is closed, and the gas bubble removal valve 67 is opened, and the pressure adjustment pump 34 is driven. Accordingly, the gas bubbles 329 in the liquid accommodating chamber 32 of the sub tank 30 are removed.

Figure 20:
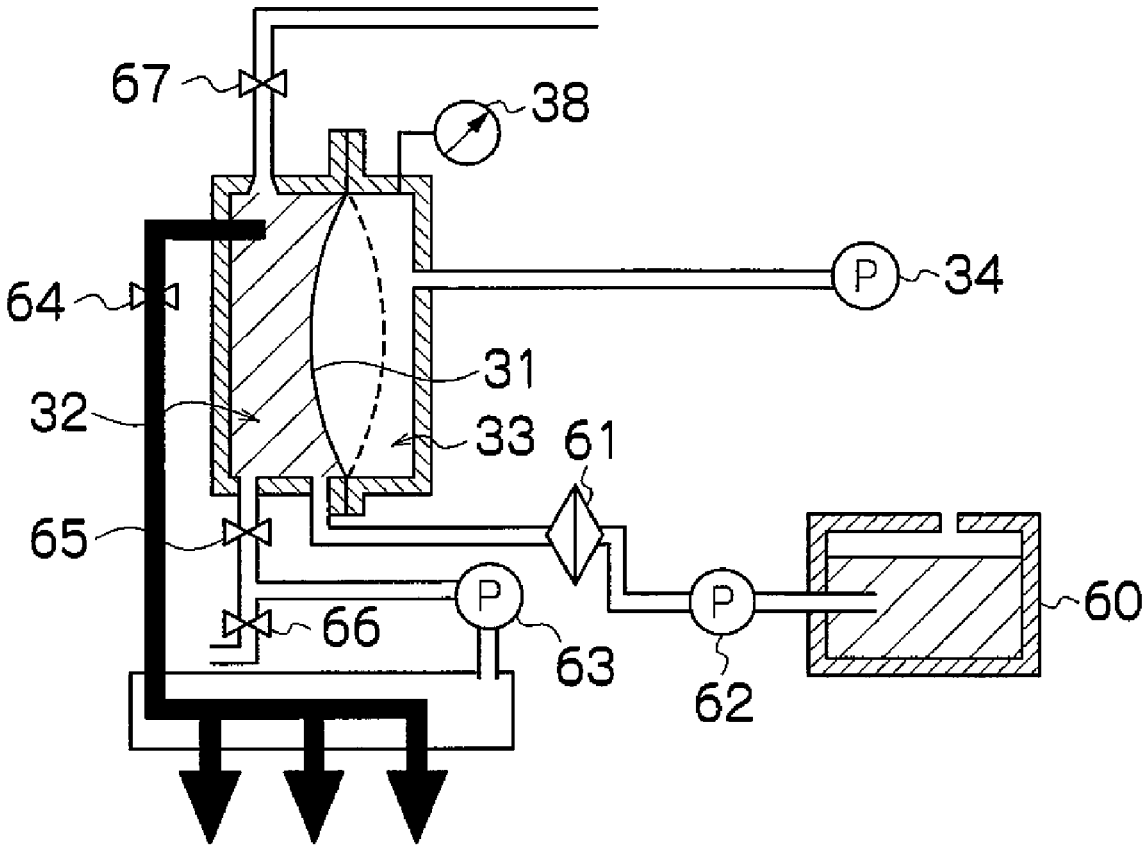
FIG. 20 is an illustrative diagram used to describe a pressurized purging process in the liquid ejection apparatus.
Figure 21A:
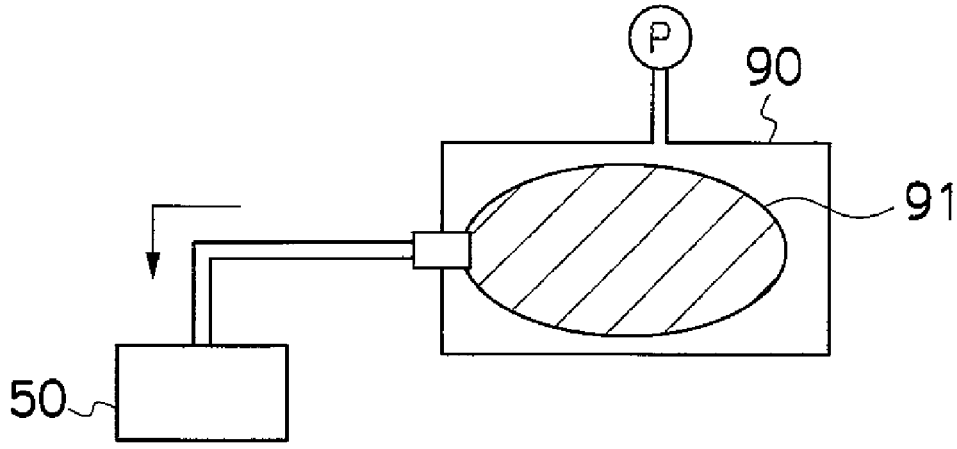
FIG.21A RELATED ART
FIGS. 21A and 21B are illustrative diagrams used to describe issues to be resolved by embodiments of the present invention.
Figure 21B:
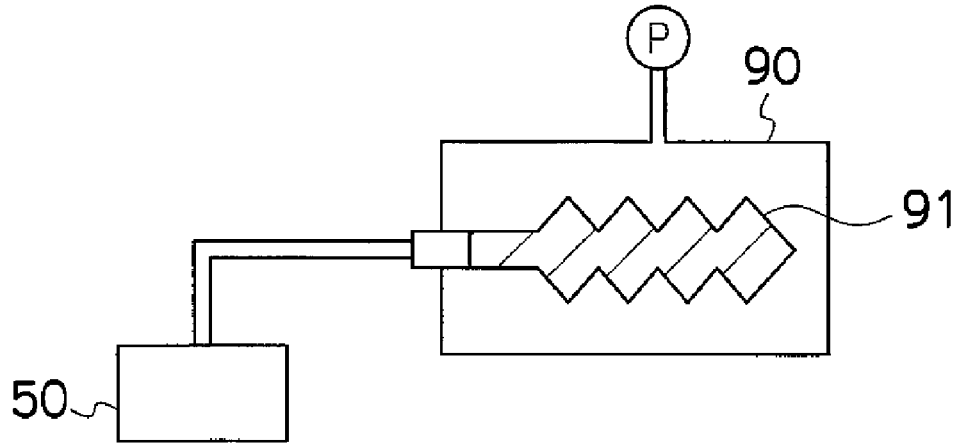
FIG.21B RELATED ART

During pressurized purging, as shown in FIG. 20, the supply flow channel opening and closing valve 64 is opened, the circulation flow channel opening and closing valve 65 is closed, the expulsion flow channel opening and closing valve 66 is closed and the gas bubble removal valve 67 is closed, and furthermore, the pressure adjustment pump 34 is driven. Consequently, the ink inside the liquid accommodating chamber 32 of the sub tank 30 is supplied to the liquid ejection head 50, and ink of high viscosity is purged (by dummy ejection) from the nozzles (reference numeral 51 in FIGS. 15A and 15B) of the liquid ejection head 50.

The initial filling process, the printing process, the gas bubble removal process, and the pressurized purging process illustrated in FIGS. 17 to 20 are implemented by the control unit 210 in FIG. 16. In these processes, the control unit 210 uses the pressures adjustment pump 34 to change the volume of the gas accommodating chamber 33 in the sub tank 30, thereby causing the movable film 31 in the sub tank 30 to deform, on the basis of the pressure of the gas in the gas accommodating chamber 33 of the sub tank 30 as determined by the pressure sensor 38 (in other words, on the basis of the pressure of the liquid in the liquid accommodating chamber 32). Accordingly, the pressure of the liquid in the liquid accommodating chamber 32 of the sub tank 30 is adjusted. In other words, the back pressure of the liquid ejection head 50 is adjusted.

The present invention is not limited to the examples described in the present specification or shown in the drawings, and various design modifications and improvements may of course be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A back pressure adjustment apparatus for a liquid ejection head, the back pressure adjustment apparatus comprising:

a container having a liquid accommodating chamber which is connected to the liquid ejection head and accommodates liquid to be supplied to the liquid ejection head, and a gas accommodating chamber which accommodates gas;

a movable film which separates the liquid accommodating chamber and the gas accommodating chamber, and forms a portion of whole walls of the liquid accommodating chamber;

a pressure adjustment pump which is connected to the gas accommodating chamber and causes the movable film to deform in such a manner that volume of the gas accommodating chamber is changed, so as to adjust pressure of the liquid accommodated in the liquid accommodating chamber;

a gas bubble removal tube, connected to an upper portion of the liquid accommodating chamber, for removing gas bubbles from the liquid accommodating chamber; and a gas bubble removal valve which opens and closes the gas bubble removal tube, wherein the movable film is aligned in a vertical direction.

2. The back pressure adjustment apparatus for a liquid ejection head as defined in claim 1, further comprising a pair of stopper members which are provided on both sides of the movable film in the container and restricts a range of movement of the movable film.

3. The back pressure adjustment apparatus for a liquid ejection head as defined in claim 1, wherein the movable film has a gas permeable portion.

4. The back pressure adjustment apparatus for a liquid ejection head as defined in claim 1, further comprising a heater incorporated with the movable film.

5. The back pressure adjustment apparatus for a liquid ejection head as defined in claim 1, further comprising:

a pressure sensor for measuring pressure of the gas accommodating chamber; and a controller which controls the pressure adjustment pump according to the pressure of the gas accommodating chamber measured by the pressure sensor so as to cause the movable film to deform in such a manner that the volume of the gas accommodating chamber is changed, so as to adjust the pressure of the liquid accommodated in the liquid accommodating chamber.

6. A back pressure adjustment apparatus for a liquid ejection head, the back pressure adjustment apparatus comprising:

a container having a liquid accommodating chamber which is connected to the liquid ejection head and accommodates liquid to be supplied to the liquid ejection head, and a gas accommodating chamber which accommodates gas;

a movable film which separates the liquid accommodating chamber and the gas accommodating chamber, and forms a portion of whole walls of the liquid accommodating chamber; and a pressure adjustment pump which is connected to the as accommodating chamber and causes the movable film to deform in such a manner that volume of the gas accommodating chamber is changed, so as to adjust pressure of the liquid accommodated in the liquid accommodating chamber, wherein:

the movable film has a quadrangle shape having a longer edge and a shorter edge, and has a perimeter edge portion which is affixed to the container, and a central portion which is joined to the perimeter edge portion; and the perimeter edge portion is divided into a region lying along the longer edge and a region lying along the shorter edge, the region lying along the shorter edge being more liable to deform than the region lying along the longer edge.

7. The back pressure adjustment apparatus for a liquid ejection head as defined in claim 6, wherein a spring constant of the region lying along the shorter edge is smaller than a spring constant of the region lying along the longer edge in such a manner that the region lying along the shorter edge is more liable to deform than the region lying along the longer edge.

8. The back pressure adjustment apparatus for a liquid ejection head as defined in claim 6, wherein a width of the region lying along the shorter edge is smaller than a width of the region lying along the longer edge in such a manner that the region lying along the shorter edge is more liable to deform than the region lying along the longer edge.

9. A back pressure adjustment apparatus for a liquid ejection head, the back pressure adjustment apparatus comprising:

a container having a liquid accommodating chamber which is connected to the liquid ejection head and accommodates liquid to be supplied to the liquid ejection head, and a gas accommodating chamber which accommodates gas;

a movable film which separates the liquid accommodating chamber and the gas accommodating chamber, and forms a portion of whole walls of the liquid accommodating chamber; and a pressure adjustment pump which is connected to the gas accommodating chamber and causes the movable film to deform in such a manner that volume of the gas accommodating chamber is changed, so as to adjust pressure of the liquid accommodated in the liquid accommodating chamber, wherein the movable film has a perimeter edge portion which is affixed to the container, and a central portion which is joined to the perimeter edge portion; and the perimeter edge portion has a lower rigidity than the central portion, wherein the perimeter edge portion and the central portion of the movable film are made of a same elastic material, and the central portion is thicker than the perimeter edge portion in such a manner that rigidity of the perimeter edge portion is lower than rigidity of the central portion.

10. The back pressure adjustment apparatus for a liquid ejection head as defined in claim 9, wherein the movable film has a lens-like shape in such a manner that the central portion is thicker than the perimeter edge portion.

11. The back pressure adjustment apparatus for a liquid ejection head as defined in claim 2, wherein a plurality of holes are opened in each of the stopper members.

12. The back pressure adjustment apparatus for a liquid ejection head as defined in claim 11, wherein surface area of openings of the plurality of holes is set to a surface area which prevents the movable film from entering the plurality of holes.

13. The back pressure adjustment apparatus for a liquid ejection head as defined in claim 2, Wherein one of the stopper members is integrated with an inner wall of the container.

14. The back pressure adjustment apparatus for a liquid ejection head as defined in claim 1, wherein the all or a portion of the movable film is constituted by a flexible film having stretch properties or an elastic film having stretch properties.

* * * * *